US012330830B2

(12) United States Patent
Juwet

(10) Patent No.: US 12,330,830 B2
(45) Date of Patent: Jun. 17, 2025

(54) WRAPPING APPARATUS AND METHOD

(71) Applicant: KATHOLIEKE UNIVERSITEIT LEUVEN, Leuven (BE)

(72) Inventor: Marc Juwet, Deinze (BE)

(73) Assignee: KATHOLIEKE UNIVERSITEIT LEUVEN, Leuven (BE)

( * ) Notice: Subject to any disclaimer, the term of this patent is extended or adjusted under 35 U.S.C. 154(b) by 0 days.

(21) Appl. No.: 18/269,075

(22) PCT Filed: Dec. 21, 2021

(86) PCT No.: PCT/EP2021/086991

§ 371 (c)(1),
(2) Date: Jun. 22, 2023

(87) PCT Pub. No.: WO2022/136369

PCT Pub. Date: Jun. 30, 2022

(65) Prior Publication Data

US 2024/0034500 A1 Feb. 1, 2024

(30) Foreign Application Priority Data

Dec. 23, 2020 (CA) ..... CA 3104009

(51) Int. Cl.
*B65B 1/00* (2006.01)
*B65B 11/02* (2006.01)
(Continued)

(52) U.S. Cl.
CPC ..... *B65B 57/12* (2013.01); *B65B 11/025* (2013.01); *B65B 41/12* (2013.01); *B65B 45/00* (2013.01);
(Continued)

(58) Field of Classification Search
CPC ..... B65B 57/12; B65B 59/001; B65B 11/025; B65B 45/00; B65B 11/045; B65B 57/04; B65B 2011/002
(Continued)

(56) References Cited

U.S. PATENT DOCUMENTS 5,174,846 A 12/1992 Bate et al.
2015/0101281 A1 4/2015 Kudia
(Continued)

FOREIGN PATENT DOCUMENTS

IT 200800010361 A1 * 5/2020 ..... B65B 11/008
IT 201800010361 A1 * 5/2020 ..... B65B 11/008
(Continued)

OTHER PUBLICATIONS

International Search Report from corresponding PCT Application No. PCT/EP2021/086991, Jul. 5, 2022.

*Primary Examiner* — Jacob A Smith
(74) *Attorney, Agent, or Firm* — Workman Nydegger

(57) ABSTRACT

A wrapping apparatus for wrapping a load includes: a wrapper delivery apparatus rotatable around the load to be wrapped; an angular position sensor at least partially mounted to the wrapper delivery apparatus; and a wrapper delivery unit mounted to the wrapper delivery apparatus. The wrapper delivery unit has a servomotor, and a wrapper delivery unit controller in data communication with the angular position sensor and operatively connected to the servomotor. The wrapper delivery unit controller is configured to process data supplied by the angular position sensor and to control the servomotor based on the processed data.

14 Claims, 16 Drawing Sheets

(51) Int. Cl.

| | |
|---|---|
| ***B65B 41/12*** | (2006.01) |
| ***B65B 45/00*** | (2006.01) |
| ***B65B 57/12*** | (2006.01) |
| ***B65B 59/00*** | (2006.01) |

(52) U.S. Cl.
CPC ..... *B65B 59/001* (2019.05); *B65B 2210/04* (2013.01); *B65B 2210/18* (2013.01)

(58) Field of Classification Search
USPC .... 53/461, 556, 588, 441, 399, 210, 64, 203
See application file for complete search history.

(56) References Cited

U.S. PATENT DOCUMENTS

| | | | | |
|---|---|---|---|---|
| 2018/0079537 | A1* | 3/2018 | Lancaster, III | B65B 61/202 |
| 2018/0273226 | A1* | 9/2018 | Lancaster, III | B65D 71/0088 |
| 2019/0002138 | A1* | 1/2019 | Laghi | B65B 41/16 |
| 2019/0177024 | A1* | 6/2019 | Lancaster, III | B65B 11/045 |
| 2020/0037657 | A1 | 2/2020 | Vecchietti et al. | |
| 2020/0281125 | A1 | 9/2020 | Baker | |

FOREIGN PATENT DOCUMENTS

| | | | |
|---|---|---|---|
| JP | 6409674 | B2 | 10/2018 |
| KR | 20140114214 | A | 9/2014 |

* cited by examiner

WRAPPING APPARATUS AND METHOD

FIELD OF THE INVENTION

The present invention is generally related to the field of a wrapping apparatus for wrapping a load with a packaging material, and more particularly, to a wrapping apparatus having a packaging material delivery assembly. It also relates to a method for wrapping a load and delivering a packaging material for wrapping a load.

BACKGROUND OF THE INVENTION

Horizontal stretch film wrapping machines (or apparatuses) are most often used to bundle a number of long profiles such as, without being limitative, wooden planks, aluminium profiles, gas pipes, etc. They mainly consist of a frame, a transfer system for the profiles and a ring that rotates in a vertical plane around a horizontally-extending axis at a rotational speed up to 240 rounds/minute and sometimes faster. A reel of film is mounted to the ring to provide a packaging film having a width which can range between about 125 mm (about 5 inch) and about 250 mm (about 10 inch). In conventional rotatable ring apparatuses, an outside diameter of a reel of film is often limited to about 30 cm. Thus, the film density being close to 1 $kg/dm^3$, the mass moment of inertia of such a reel of film is between 0.1 and 0.2 $kgm^2$.

For a wrapping process the loads, such as profiles, are conveyed through the open ring and wrapped by fixing a free end of the film thereon and then rotating the ring carrying the reel of film about the load. During the wrapping cycle the reel of film is unwinded by a pulling force that is generated in the web of film that is being wrapped around the load. The average pulling force can be increased by breaking the rotation of the reel of film relative to the ring. Breaking is performed by creating friction, via a mechanical brake or other suitable tools. The amount of film per second required to wrap a non-cylindrical load, i.e. the speed of the film, varies in accordance with an angular position of the reel of film with respect to the load (or around a circumference of the ring). This variation in the speed of film delivered to the load causes a variation in the stretch of the film since the inertia of the reel of film being between 0.1 and 0.2 $kgm^2$ as detailed above, is too high to cope with these fast speed variations. Despite the stretch variations, the pulling force, in the web of film being wrapped around the load, does not vary significantly if an appropriate film type is used. In fact, for such types of film, the pulling force is almost constant for a stretch ratio between about 100 to about 300%. Thus, by simply rotating the ring around the load, the stretched film is wrapped around the load with an almost constant pulling force.

E-commerce products are most often shipped in boxes that are larger than the actual product. Free space is filled using chips, scrumbled paper, foam, and other similar materials to avoid damage of the product during the journey from packaging to final customer. Typically, packaging in an e-commerce environment requires manual labour. Therefore, there is a need for a packaging concept that can be automated easily.

In suspension packaging, one or more products (or items to ship) are fixed on a piece of supporting tray, typically a corrugated board, most often by wrapping stretched wrap film around the product on the board. The board is slipped into a box for shipping. The product is therefore protected by a gap of air between the product and five sides of the outside box.

Horizontal stretch wrapping machines, as described above, are used to wrap heavy fragile rigid products (or items), in a suspension packaging, since they do not move on the board during wrapping, e.g. an electrical or hydraulic motor and the like. This packaging concept is very promising for other products, regardless of their weight or shape or position on the supporting tray, but with the available wrapping technology it is currently limited to heavy products since the pulling force in the stretched film would force lighter products to slide on the supporting tray at least at the beginning of the wrapping cycle.

There is thus a need for a wrapping apparatus and an associated method for wrapping an item which could wrap any item, regardless of its weight, on a supporting tray. In some implementations the wrapping should be done automatically and the wrapped item should be protected on all sides.

In view of the above, there is a need for a wrapping apparatus and an associated method for wrapping an item which would be able to overcome or at least minimize some of the above-discussed prior art concerns.

SUMMARY OF THE INVENTION

It is therefore an aim of the present invention to address the above mentioned issues.

According to a general aspect, there is provided a wrapping apparatus for wrapping a load comprising: a wrapper delivery apparatus rotatable around the load to be wrapped; an angular position sensor at least partially mounted to the wrapper delivery apparatus; and a wrapper delivery unit mounted to the wrapper delivery apparatus, the wrapper delivery unit comprising a servomotor and a wrapper delivery unit controller arranged to be in data communication with the angular position sensor and operatively connected to the servomotor, the wrapper delivery unit controller being configured to process data supplied by the angular position sensor and to control the servomotor based on the processed data.

In an embodiment the angular position sensor comprises a gyroscope.

In an embodiment the wrapper delivery unit controller determines an angular position of the wrapper delivery apparatus around the load using the data supplied by the angular position sensor and controls the servomotor based on at least the determined angular position of the wrapper delivery apparatus around the load.

In an embodiment the wrapper delivery apparatus comprises a vertically-oriented rotatable ring configured to rotate in a vertical plane around a horizontally-extending axis and the wrapper delivery unit is mounted to the rotatable ring.

In an embodiment the wrapper delivery unit comprises a stretch roller and the servomotor comprises a stretch roller servomotor operatively connected to the stretch roller to engage the stretch roller in rotation.

In an embodiment the wrapper delivery unit comprises a reel of packaging material and the servomotor comprises a reel servomotor operatively connected to the reel of packaging material to engage the reel of packaging material in rotation.

According to a general aspect, there is provided a method for wrapping a load comprising: engaging in rotation a wrapper delivery apparatus around a load, the wrapper delivery apparatus including an angular position sensor and a wrapper delivery unit with a servomotor; sending data collected by the angular position sensor to a wrapper delivery unit controller; deriving an angular position of the wrapper delivery apparatus using data supplied by the angular position sensor; and adjusting a speed of the servomotor driving the wrapper delivery unit as a function of the angular position of the wrapper delivery apparatus. The load consists of one or more items positioned on a supporting tray.

In an embodiment the angular position of the wrapper delivery apparatus comprises an angular position of the wrapper delivery unit mounted to the wrapper delivery apparatus.

In an embodiment engaging in rotation a wrapper delivery apparatus around a load comprises engaging in rotation a rotatable ring in a vertical plane around a horizontally-extending axis.

According to yet another general aspect, there is provided an apparatus for delivering tensioned wrapper. The apparatus comprises: a wrapper reel receiving unit comprising a wrapper reel receiving shaft defining a reel servomotor receiving cavity and a reel servomotor at least partially inserted in the reel servomotor receiving cavity and configured to engage the wrapper reel receiving shaft in rotation, the wrapper reel receiving shaft being configured to receive and support a wrapper reel.

In an embodiment the apparatus to deliver a tensioned wrapper further comprises: a driven stretch roller and a stretch roller servomotor operatively connected to the driven stretch roller to engage same in rotation. The driven stretch roller can define a roller servomotor receiving cavity and the stretch roller servomotor is inserted in the roller servomotor receiving cavity and configured to engage the driven stretch roller in rotation.

In an embodiment the wrapper reel receiving unit, the driven stretch roller and the stretch roller servomotor are components of a wrapper delivery unit and the driven stretch roller is a sole stretch roller of the wrapper delivery unit.

In an embodiment the reel servomotor comprises a brushless DC motor including a stator and a rotor. In one embodiment there can be a series of coils on the stator and permanent magnets at an inner side of the rotor. In another embodiment it is just the other way round, i.e. the stator has permanent magnets and the rotor comprises at an inner side a series of coils.

In an embodiment the reel servomotor comprises an outrunner brushless DC motor.

According to a further general aspect, there is provided an apparatus for delivering tensioned wrapper comprising: a wrapper reel receiving unit comprising a wrapper reel receiving shaft configured to receive and support a wrapper reel and a reel servomotor operatively connected to and configured to drive the wrapper reel, a driven stretch roller, and a stretch roller servomotor operatively connected to the driven stretch roller to drive the driven stretch roller. In an embodiment the stretch roller servomotor is operatively connected to the driven stretch roller to engage the driven stretch roller in rotation.

In an embodiment the wrapper reel receiving shaft of the wrapper reel receiving unit defines a reel servomotor receiving cavity and the reel servomotor is inserted in the reel servomotor receiving cavity and configured to engage the wrapper reel receiving shaft in rotation.

In an embodiment the driven stretch roller defines a roller servomotor receiving cavity and the stretch roller servomotor is inserted in the roller servomotor receiving cavity and configured to engage the driven stretch roller in rotation.

In an embodiment at least one of the reel servomotor and the stretch roller servomotor comprises a brushless DC motor including a stator and a rotor. In one embodiment there can be a series of coils on the stator and permanent magnets at an inner side of the rotor. In another embodiment it is just the other way round, i.e. the stator has permanent magnets and the rotor comprises at an inner side a series of coils.

In an embodiment at least one of the reel servomotor and the stretch roller servomotor comprises an outrunner brushless DC motor.

In an embodiment the wrapper reel receiving unit, the driven stretch roller and the stretch roller servomotor are components of a wrapper delivery unit and the driven stretch roller is a single stretch roller of the wrapper delivery unit.

According to another general aspect there is provided a wrapping apparatus comprising the apparatus suitable for the delivery of a tensioned wrapper as described above, further comprising a frame including an electrical contact point and the apparatus for delivering a tensioned wrapper further comprises at least one capacitor and an electrical contact point complementary to the electrical contact point of the frame and being in electrical communication therewith in a predetermined stationary configuration of the apparatus for tensioned wrapper delivery with respect to the frame, the at least one capacitor being in electrical communication with the electrical contact point of the apparatus for delivering tensioned wrapper and the reel servomotor to be fed with electric power by the electrical contact point of the frame in the predetermined stationary configuration of the apparatus for tensioned wrapper delivery and to feed the reel servomotor with electric power.

According to a further general aspect there is provided a method for wrapping a load comprising: obtaining a wrapper stretch ratio; obtaining a wrapper demand; and adjusting at least one of a reel servomotor and a stretch roller servomotor as a function of the wrapper stretch ratio and the wrapper demand.

In an embodiment the method further comprises adjusting an angular speed of the stretch roller servomotor based on the wrapper stretch ratio and adjusting an angular speed of the reel servomotor based on a real-time length of packaging material to be delivered to the load being wrapped.

According to still another general aspect, there is provided a method for wrapping a load comprising obtaining an image from a load to be wrapped, i.e. from the item(s) positioned on the supporting tray; deriving a wrapping path of a packaging material; and wrapping the packaging material around the load supported on the supporting tray using the derived wrapping path. The load is formed by one or more items positioned on a supporting tray.

In one embodiment the method further comprises determining at least one closed convex girth of the load and using the closed convex girth to deriving the wrapping path.

In an embodiment obtaining an image from the load comprises scanning the load and obtaining a 3D point cloud of at least a part of the item(s) and the tray. The method can further comprise image processing the obtained 3D point cloud (for example, removing borders of the image) and calculating a plurality of transverse cross-sections extending perpendicular to a surface of the supporting tray and parallel to each other. In an embodiment, determining at least one closed convex girth of the load comprises determining one closed convex girth for each one of the transverse cross-sections.

In an embodiment deriving a wrapping path of a packaging material comprises conforming the wrapping path to the closed convex girth s along a length of the load.

In an embodiment wrapping the packaging material around the load comprises calculating a target packaging material force along at least a part of the wrapping path and adjusting a delivery speed of the packaging material as a function of the target packaging material force.

According to still another general aspect, there is provided a method for wrapping a load comprising: wrapping the load with a first web of packaging material; and wrapping the load with a second web of packaging material, wherein the second web of packaging material defines one of a perpendicular angle and an oblique angle with the first web of packaging material. The load is formed by one or more items positioned on a supporting tray.

In an embodiment the method further comprises rotating the load between wrapping with the first web of packaging material and wrapping with the second web of packaging material.

In an embodiment the method further comprises wrapping the load with the first web of packaging material with a first wrapping apparatus; withdrawing the load from the first wrapping apparatus, inserting the load from a second wrapping apparatus, and then, wrapping the load with the second web of packaging material with the second wrapping apparatus.

According to still another general aspect, there is provided a wrapped load comprising: a 3D load having an outer surface; a first web of packaging material forming at least one first loop surrounding the 3D load; and a second web of packaging material forming at least one second loop surrounding the 3D load and oriented perpendicular to or at an oblique angle with the at least one first loop. The 3D load is made up of one or more items positioned on a supporting tray.

In an embodiment the 3D load comprises a supporting tray, which can consist of superposed boards. For instance, the superposed boards can comprise corrugated cardboards, wherein flutes of a first one of the corrugated cardboard are oriented in an orthogonal direction to flutes of a second one of the corrugated cardboards.

In another aspect the invention relates to a method for wrapping an item placed on a supporting tray, said supporting tray comprising an item supporting portion and outer portions. The method comprises: providing trapezium-shaped cut-out portions on at least a part of opposing sides of the item supporting portion and giving the trapezium-shaped cut-out portions a stepwise inwardly decreasing length, the length being measured in a direction parallel to the opposing sides.

According to still a further general aspect, there is provided a method for wrapping a load comprising wrapping a load using stretchable cellulose-based paper stretchable from about 10% to about 30% of its length, having a thickness ranging between about 50 grams/square meter ($g/m^2$) to about 400 $g/m^2$.

According to still another general aspect, there is provided a wrapped load comprising: a 3D load having an outer surface surrounded at least partially by a packaging material comprising stretchable cellulose-based paper stretchable from about 10% to about 30% of its length, having a thickness ranging between about 50 grams/square meter ($g/m^2$) to about 400 $g/m^2$. The packaging material is taken from a reel of packaging material, said reel being connected to a single reel servomotor.

In this specification the term "item" is intended to include articles and products that need to be wrapped for shipping or storage purposes. Items may be rigid or deformable.

In this specification the term "load" is intended to mean the item(s) (for instance a bundle of grouped items) supported on a same supporting tray, which are wrapped by a wrapping apparatus. The load is formed by one or more items supported on a same supporting tray. The items and the load as a whole can have a rectangular cross-section or other non-circular and/or irregular cross-sections.

In this specification the terms "packaging material" or "wrapper" are used interchangeably and are intended to include any material applied around a load being wrapped that serves to contain and/or protect the load. The packaging material is typically made of a stretchable material including but without being limitative a plastic-based film or a paper-based film.

The packaging material can be stretchable in that it can be extended at least in length before breakage. The packaging material can be a stretchable wrap film, such as a HDPE-based film, that can be stretched considerably before breakage (variable in accordance with the nature of the stretchable wrap film). For instance, a stretch ratio between about 100 and about 500% can be reached. A conventional stretchable wrap film can have a thickness, before stretching, ranging between about 8 and about 30 microns. It can be delivered on reels having an inner diameter of about 76 mm (3 inch) and an outer diameter up to about 40 cm. For horizontal stretch wrapping machines, a width of the web of film can be up to either 125 mm or 250 mm (5 or 10 inch). The stretchable plastic-based wrap film can show resilient properties in that, after stretching and then releasing the pulling force, the wrap film will contract. Contraction can reach 100% of an unstretched length.

The stretched wrap film can consist of a plurality of superposed layers. For instance and without being limitative, the inner and/or the outer sides of the film web can have a "cling" effect, meaning that it shows adhesiveness when stretched and wrapped over another layer of packaging material or over the load, i.e. it will substantially adhere to the load and/or to another packaging material layer. Thus, if the packaging material comprises an adhesive surface, at the end of the wrapping cycle, the packaging material can be simply cut when completing the last revolution without further need to attach its free end to the wrapped load.

As mentioned above, in some implementations, the packaging material can also be a stretchable paper, also referred to as a flexible paper or a highly deformable paper, and which should not be confused with crepe paper. This includes cellulose based films that can be stretched from about 10% up to about 30% before breakage depending on the nature of the film and the environmental conditions. Stretchable paper shows most often a high energy absorption when deformed. In comparison with stretchable plastic-based wrap films, contraction after releasing the pulling force is often limited to about 5% of the unstretched length. A conventional stretchable paper can have a thickness ranging between about 50 to about 400 $g/m^2$ (grams/square meter). For instance and a without being limitative, a typical thickness for wrapping a load with an horizontal stretch wrapping machine, the thickness can range between about 75 g/m2 and about 125 $g/m^2$. For some very heavy loads to be wrapped, or loads subject to very high forces or loads having very sharp edges, stretchable paper characterized by a thickness ranging between about 250 $g/m^2$ and about 400 $g/m^2$ can be used as a packaging material. The breaking strength of these paper types can reach up to 60N/cm or more. The width of wrapping paper can therefore for most loads be limited to about 2 cm to 5 cm if there is no need to cover the outer surface of the load.

In this specification the term "tensioned" is intended to mean that, when applied on the load, at least a small internal pulling force in the wrapper, for instance higher than 0.1% of the breakage strength, has been created during or after application of the wrapper. A pulling force can be quantified as any other force and expressed in N but in the packaging field, it is expressed also as force per unit width of a wrapper web in N/m or even as a force per unit section of a wrapper in $N/m^2$.

In this specification the terms "circumferential speed" and "revolution speed" are used interchangeably and are intended to mean the number of revolutions per unit of time. It can be used with respect to the number of relative revolutions between the load and the wrapper delivery apparatus per unit of time. For instance, for a rotatable ring, it is intended to mean the number of revolution(s) of the wrapper delivery apparatus around the load per unit of time. It can also be used with respect to the number of revolutions of the stretch roller(s) or the reel of packaging material about their own rotation axes per unit of time.

The present document may refer to a number of documents, the contents of which are hereby incorporated by reference in their entirety.

BRIEF DESCRIPTION OF THE DRAWINGS

The invention will now be described further, by way of example, with reference to the appended drawings, wherein like reference numerals refer to like elements in the various figures.

DETAILED DESCRIPTION OF ILLUSTRATIVE EMBODIMENTS

Figure 1:
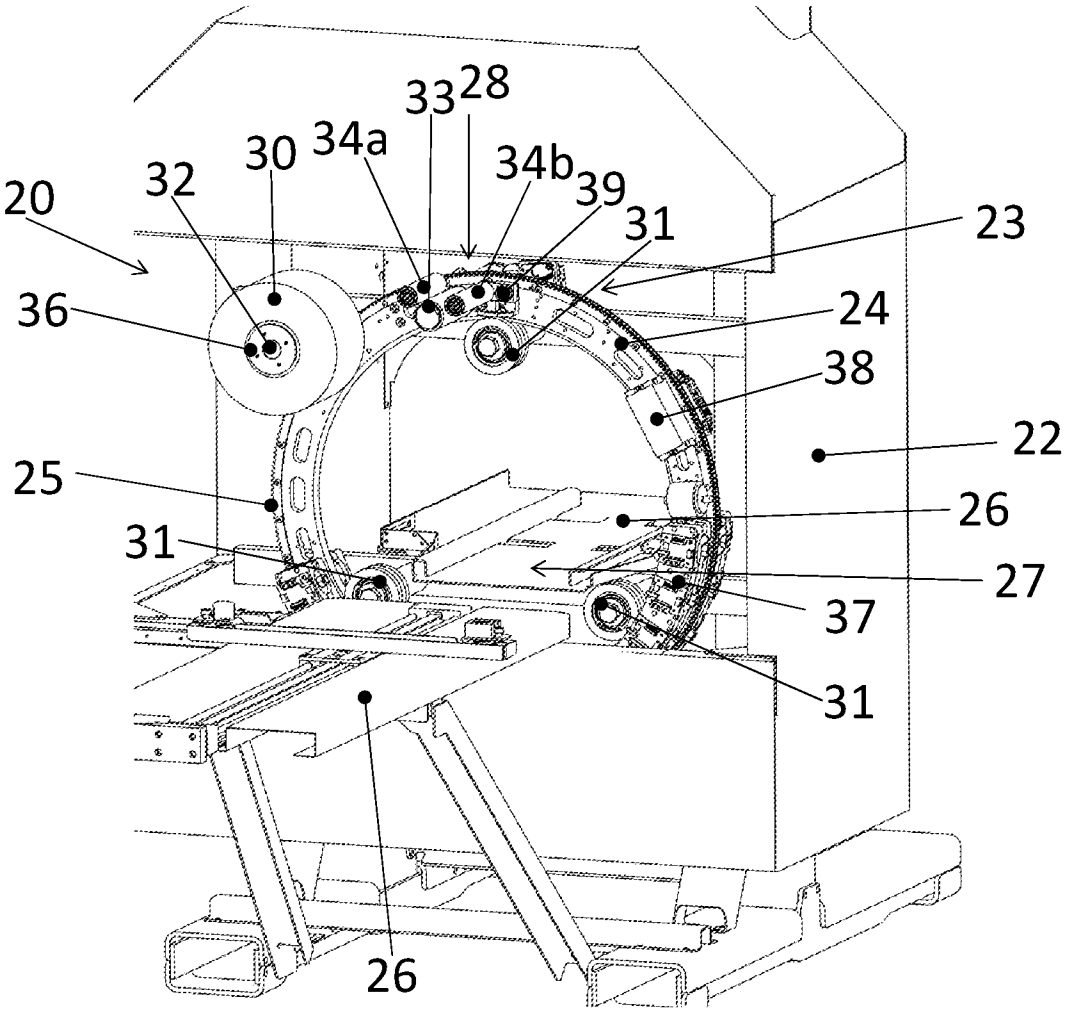
FIG. 1 is a rear perspective view of a wrapping apparatus in accordance with a first embodiment.

Moreover, although the embodiments of the wrapping apparatus and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therein between, as well as other suitable geometrical configurations, may be used for the wrapping apparatus, as will be briefly explained herein and as can be easily inferred herefrom by a person skilled in the art.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of the wrapping apparatus and the load. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value. It is commonly accepted that a 10% precision measure is acceptable and encompasses the term "about".

In the above description, an embodiment is an example or implementation of the inventions. The various appearances of "one embodiment," "an embodiment" or "some embodiments" do not necessarily all refer to the same embodiments. Furthermore, reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

Although various features of the invention may be described in the context of a single embodiment, the features may also be provided separately or in any suitable combination. Conversely, although the invention may be described herein in the context of separate embodiments for clarity, the invention may also be implemented in a single embodiment.

It is to be understood that the phraseology and terminology employed herein is not to be construed as limiting and are for descriptive purpose only.

The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. It is to be understood that where the claims or specification refer to "a" or "an" element, such reference is not be construed that there is only one of that element.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

The descriptions, examples, methods and materials presented in the claims and the specification are not to be construed as limiting but rather as illustrative only. The present invention may be implemented in the testing or practice with methods and materials equivalent or similar to those described herein.

Meanings of technical and scientific terms used herein are to be commonly understood as by one of ordinary skill in the art to which the invention belongs, unless otherwise defined.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

Figure 2:
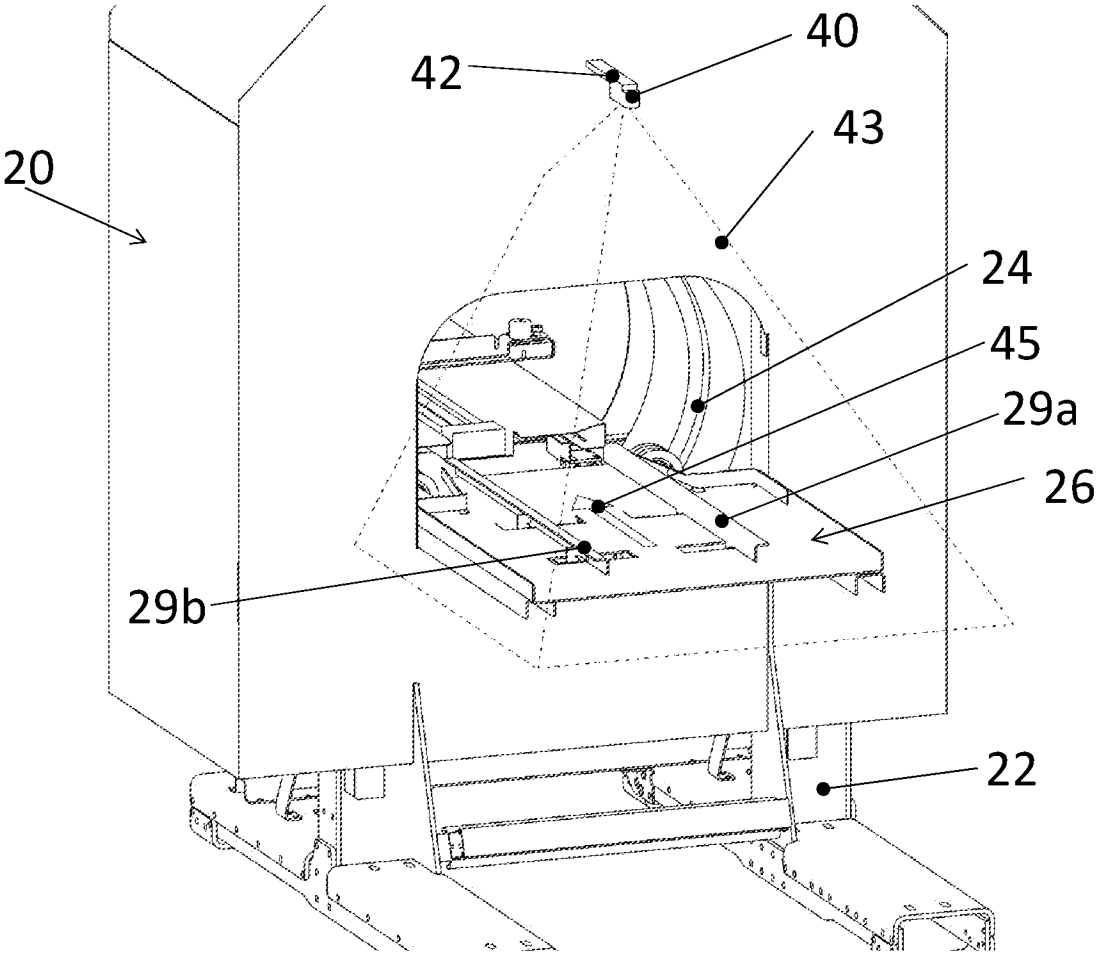
FIG. 2 is a front perspective view of the wrapping apparatus shown in FIG. 1, showing a load scanner and its field of view, upstream a wrapping zone of the wrapping apparatus.
Figure 3:
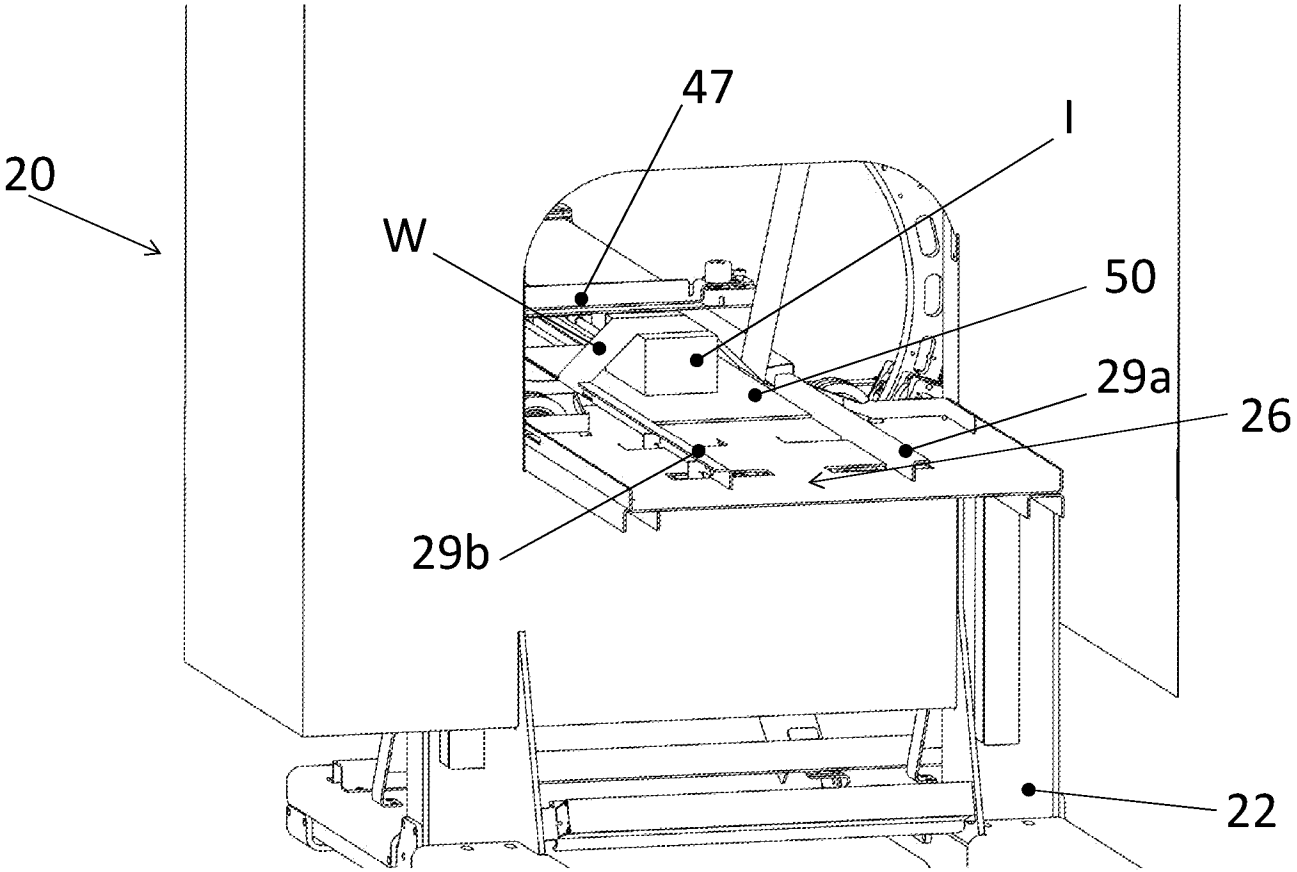
FIG. 3 is a rear perspective view of the wrapping apparatus shown in FIG. 1, with a load being wrapped.

Referring now to the drawings and, more particularly, referring now to FIGS. 1 to 3, there is shown an embodiment of a wrapping apparatus 20 for wrapping a load L, i.e. one or more items placed on a supporting tray. In the embodiment shown, the wrapping apparatus 20 is a horizontal wrapping apparatus and, more particularly, a horizontal stretch wrapping apparatus. The wrapping apparatus 20 comprises a frame 22 (i.e. the stationary part of the horizontal stretch wrapping apparatus) supporting a wrapper delivery apparatus 23 (i.e. the rotatable part of the horizontal stretch wrapping apparatus), and a load transfer system 26.

In the embodiment shown the wrapper delivery apparatus 23 comprises a vertically-oriented rotatable ring 24, which is rotatably mounted to the frame 22 and configured to rotate in a vertical plane around a horizontally-extending axis H extending centrally to the ring 24.

In the non-limitative embodiment shown the load transfer system 26 is embodied by one or more sequentially mounted load conveyor(s) which is (are) designed to feed a wrapping zone 27, located inside the annular ring 24, with loads L to be wrapped and to withdraw wrapped loads from the wrapping zone 27. The load transfer system 26 displaces the loads L along a conveying direction represented by arrow 45 in FIG. 2. It is appreciated that the load transfer system 26 can differ from the load conveyor shown.

In the non-limitative embodiment shown in FIGS. 2 and 3, upstream and downstream the wrapping zone 27, the load transfer system 26 includes a centring system 29*a*, 29*b*, which is used to centre the loads L to be wrapped in a transverse direction, i.e. in a direction perpendicular to the conveying direction 45. In the non-limitative embodiment shown, each section of the centring system 29*a*, 29*b* comprises a pair of rails, spaced-apart from one another along the transverse direction.

In this specification the term "wrapping zone" is intended to mean the place wherein the loads L are located while being wrapped by the wrapping apparatus 20. For the horizontal stretch wrapping apparatus show, the wrapping zone 27 is located inside the annular-shaped rotatable ring 24.

In the non-limitative embodiment shown in FIG. 3, the load transfer system 26 comprises in the wrapping zone 27 a servo driven spindle carrying a gripper 47 to move the loads L forward and backward. In an alternative embodiment a stepper motor may be used instead.

As known in the art, the wrapping apparatus 20 comprises a wrapper delivery apparatus actuator to create a relative rotation between the load L and the wrapper delivery apparatus 23 during the wrapping process. In the shown embodiment the wrapper delivery apparatus actuator comprises a motor and a toothed belt gears (not shown) mounted to the frame 22 engaged with teeth 25 provided at a periphery of the rotatable ring 24. It is appreciated that, in a non-limitative alternative embodiment, the toothed belt could be replaced by gear(s) and pinion drive(s). Therefore, the engagement between the wrapper delivery apparatus actuator and the teeth 25 drive the rotatable ring 24 in rotation about the wrapping zone 27.

In the non-limitative embodiment shown in FIG. 1, the rotatable ring 24 is supported by three support wheels 31 at a ring inner side and driven over teeth 25 on the ring outer side. In an alternative embodiment (not shown), the support wheels could be mounted at a ring outer side, while the teeth 25 could be located at the ring inner side to be used as a rack-pinion system.

The loads L, which are carried by the load transfer system 26 and wrapped by the wrapping apparatus 20, can include a single item I on a supporting tray 50, as shown in FIG. 3, or a bundle of grouped items on a tray. The items I and the resulting load L to be wrapped can have any shape, they can be characterized by a very low to a very high average density, they are not limited by the type of friction on their outer surfaces and can show sharp edges. The presence of sharp edges is advantageously used to define a desired tension force in the wrapping apparatus along its revolution around the load. The tension force is reduced when wrapping over a sharp edge.

The wrapper delivery apparatus 23 further comprises a wrapper delivery unit 28 (also referred to as packaging material dispenser) which, in the embodiment shown, is fixedly mounted to the rotatable ring 24 to rotate therewith. It is appreciated that, in another embodiment (not shown) the ring could be stationary and the wrapper delivery unit 28 can be displaceable along the ring circumference or any variation thereof provided that relative rotation between a load to be wrapped and the wrapper delivery unit 28 is provided.

In the embodiment shown the components of the wrapper delivery unit 28 are mounted directly to the rotatable ring 24. However, it is appreciated that in an alternative embodiment (not shown) the components of the wrapper delivery unit 28 can be mounted to a delivery unit frame, which in turn is mounted to the rotatable ring 24 and rotates therewith.

Amongst others, the wrapper delivery unit 28 includes a wrapper reel receiving unit mounted to and supported by the rotatable ring 24. The wrapper reel receiving unit is configured to receive and support a reel of packaging material (or wrapper) 30. In the embodiment shown, the wrapper reel receiving unit comprises a wrapper reel receiving shaft 32 onto which the reel of wrapper 30 can be removably mounted.

In some implementations the wrapper delivery unit 28 can be a stretch wrapper delivery unit 28 that delivers packaging material W in a stretched state to the load L being wrapped. Thus, in such embodiment, the wrapper delivery unit 28 can further include one or more stretch rollers (often, a first and a second stretched roller, also referred to as an upstream and a downstream stretch roller), a dancer bar (provided downstream to the stretch roller(s)) and a plurality of rollers, which can be idle rollers, to guide the packaging material W in the wrapper delivery unit 28. The stretch roller(s), the dancer bar, and the plurality of secondary rollers, if any, are also mounted to the rotatable ring 24 or to the delivery unit frame, if any.

In the embodiment shown in FIG. 1, the wrapper delivery unit 28 is a stretch wrapper delivery unit 28 including a stretch roller 33 located between two idle rollers 34*a*, 34*b* and configured to increase the contact angle of the packaging material W with the stretch roller 33. The stretch roller 33 has an anti-slip (non-skid) coating to increase friction with the packaging material W. It is appreciated that the configuration of the wrapper delivery unit 28 can differ from the embodiment shown in FIG. 1.

It is appreciated that the horizontal wrapping apparatus can be replaced by other types of wrapping apparatus including, and without being limited to, a turntable, a rotating arm, a vertical rotatable (rotating) ring, and the like, wherein relative rotation is provided between the load and the packaging material dispenser (or the wrapper delivery unit) to wrap packaging material W about the sides of the load. For rotating arm wrapping apparatuses and vertical/horizontal rotatable (rotating) ring wrapping apparatuses, the rotatable part of the wrapping apparatus carries the wrapper delivery apparatus 23 and its wrapper delivery unit 28 while the stationary part of the wrapping apparatus is the frame. On the contrary, for turntables, the rotatable part of the wrapping apparatus supports the loads to be wrapped while the wrapper delivery apparatus 23 and its wrapper delivery unit 28 are part of the stationary part of the wrapping apparatus.

Similarly, at least some of the methods described below can be performed with other wrapping apparatuses than the horizontal wrapping apparatus shown in FIG. 1. In addition, the wrapping apparatuses can include a wrapper delivery unit configured to provided packaging material W in a stretched state to the load being wrapped or not.

Referring now to FIG. 2, there is shown that in some implementations the wrapping apparatus 20 can include a load scanner 40, which can be mounted to the frame 22, and an image processing unit 42 in data communication with the load scanner 40. The image processing unit 42 can be contained in a housing of the load scanner 40 or can be a separate physical component, as shown in FIG. 2. It can be located in proximity to the load scanner 40 or at a remote location. For instance and without being limitative, the load scanner 40 can include a 3D camera, which determines three spatial coordinates for all points within its field of vision. As an alternative the three spatial coordinates can be calculated from lines scanned by a 2D scanner during a relative movement of the 2D scanner and the load.

In the embodiment shown, the load scanner 40 is mounted to the frame 22 above the load transfer system 26 and upstream of the wrapping zone 27. Its field of view 43, represented by the dashed lines in FIG. 2, is directed downwardly and towards the load transfer system 26 to scan the loads L before they are introduced in the wrapping zone 27. In some embodiments the load scanner 40 is mounted above the loads L and at a distance therefrom to include an entirety of the loads L in its field of view 43. It is appreciated that, if the loads L to be scanned are really long, the entirety of each load L may not be in the field of view 43 of the load scanner 40 simultaneously and images taken from the load scanner can be combined by the image processing unit 42, for instance.

Thus, the loads L are placed on the load transfer system 26, upstream of the wrapping zone 27, and displaced towards the wrapper delivery apparatus 23 in the direction indicated by the arrow 45. The load scanner 40 is configured to scan the loads L as they pass in its field of view 43. The loads L can be stationary or displaced while being scanned.

As mentioned above, the loads L include a supporting tray 50 and one or more items I supported by the tray 50. The item(s) are placed on the supporting tray 50 before being scanned, i.e. upstream of the load scanner 40.

The imaging data obtained by the load scanner 40 are sent to the image processing unit 42. For instance, the 3D point cloud generated by the load scanner 40 is processed in the image processing unit 42 to clean the point cloud to detect and correct or remove inaccurate points, for instance, by filtering or another suitable data processing technique. Existing techniques may be used, for example edge preserving filtering to distinguish between a sharp edge/pin and noise on the data. In case a sharp edge is detected, this is used to calculate the tension force in the film.

Figure 4:
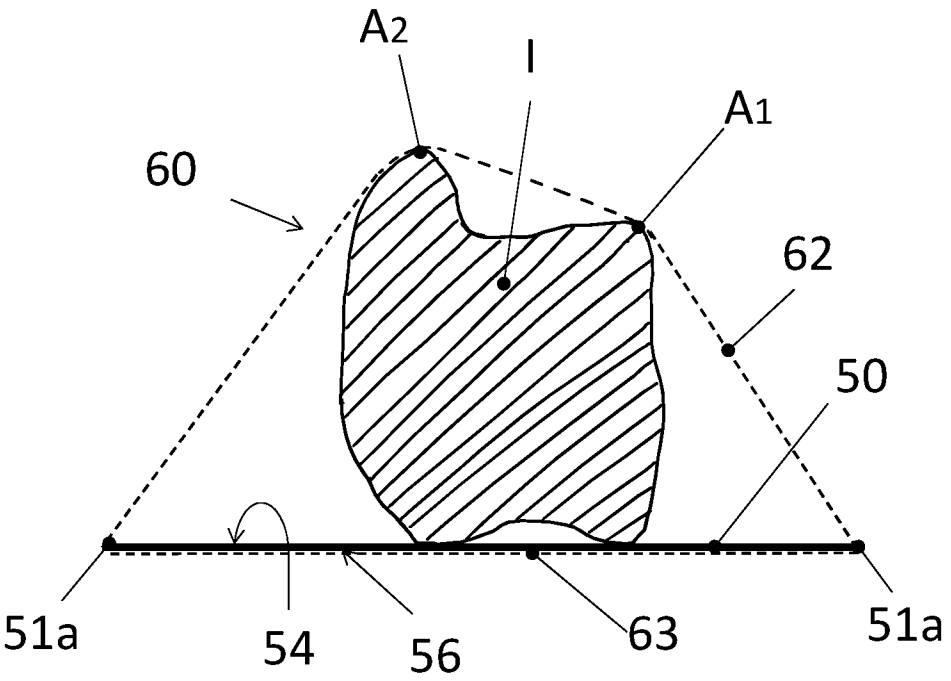
FIG. 4 is a schematic cross-section view of a transverse cross-section for a load including an item supported on a supporting tray and representing a closed convex girth derived therefrom.
Figure 5:
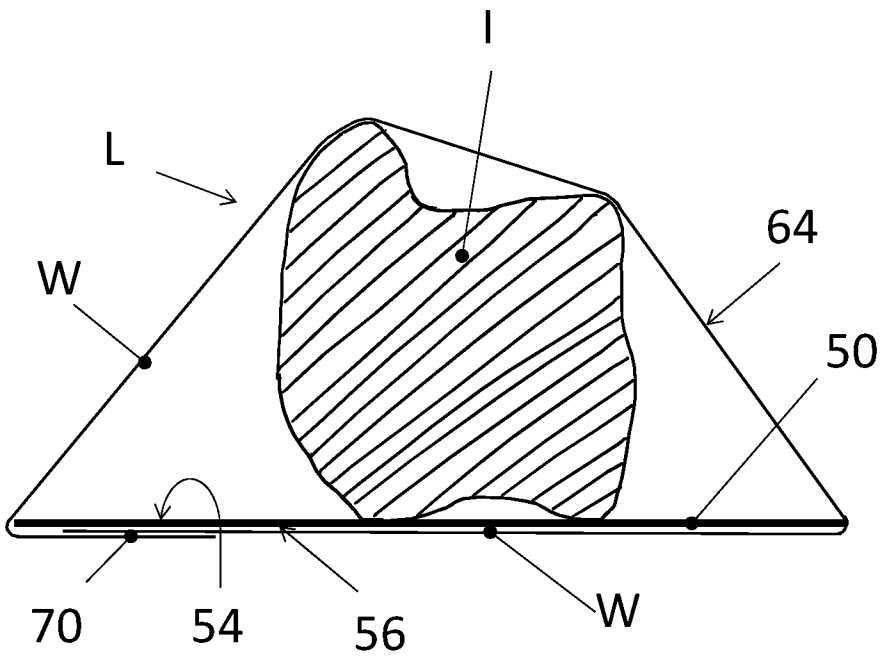
FIG. 5 is schematic cross-section view of a load including an item supported on a supporting tray and a packaging material wrapped along a wrapping path derived from a closed convex envelope.

Referring now to FIGS. 3 to 5, load L again comprises one or more items placed on a supporting tray 50 and the image processing unit 42 determines/calculates, using the cleaned imaging data, a plurality of transverse cross-sections 60 extending perpendicular to an upper surface 54 of the supporting tray 50 (that is going to be parallel to the axis of the wrapping in a later step). If the upper surface 54 of the supporting tray 50 extends horizontally, these transverse cross-sections 60 extend vertically. A distance between adjacent ones of the transverse cross-sections 60 can vary in accordance with the size of the load L being wrapped and the precision of the load scanner 40. In an embodiment the distance between adjacent ones of the transverse cross-sections 60, along an axis extending parallel to the conveying direction 45, ranges between about 4 mm and about 40 mm. Using an apex of each transverse cross-section 60, a convex curve 62 is derived and combined with a line 63 corresponding to a bottom surface 56 of the supporting tray 50 to form a closed convex girth 64 surrounding and more particularly circumscribing the load L. A closed convex girth should be interpreted as performing a full revolution of the load, but this does not exclude an offset in the conveying direction, for example an offset of a few cm. Since the bottom/lower surface 56 of the supporting tray 50 is typically outside the field of view 43 of the load scanner 40, if the latter is positioned above the load L, it is assumed that the bottom surface 56 of the supporting tray 50 is flat and its position is derived from the position of the upper surface 54. It is appreciated that the accuracy and reliability of the closed convex girth 64 can be improved by carrying out a plurality of load imaging processes and combining the imaging data obtained from each one of the load imaging processes. A non-limitative example is shown in FIG. 4 wherein the load L includes two apexes A1, A2 and combined with opposed transversal ends 51*a*, 51*b* of the supporting tray 50 to derive the convex curve 62 for one of the transverse cross-sections 60 is derived and combined with the line 63 corresponding to the bottom surface 56 of the supporting tray 50 to form the closed convex girth 64 surrounding and more particularly circumscribing the load L.

Thus, the image processing unit 42 calculates a plurality of closed convex girths 64, one for each transverse cross-section 60. The data corresponding to the plurality of closed convex girths 64 are transferred to a main control system (not shown) of the wrapping apparatus. The main control system can be mounted to the wrapping apparatus 20 or located at a remote location.

The main control system combines the information associated to the closed convex girths 64 and derives a wrapping path for the packaging material W. As the load L can be displaced during the wrapping process (i.e. moved either forward or rearward) and the shape of the transverse cross-sections of the item(s) I can vary along a length of the item(s), the wrapping path can vary during the wrapping process depending on the portion of the item(s) being wrapped. In other words, the wrapping path can vary during the relative revolutions between the load L and the wrapper delivery unit 28. The information from the closed convex girths 64 is combined to derive the wrapping path as a function of each one of the relative revolutions between the load L and the wrapper delivery unit 28.

For rectangular-shaped items supported on a supporting tray 50, this step can be omitted since a shape of all transverse cross-sections is substantially identical.

Furthermore, the packaging material W can be applied to the load L along a helical wrapping path, a cylindrical wrapping path or a combination thereof. More particularly, if the packaging material is sufficiently wide, there may be no need for moving forward/rearward the load L during the wrapping process and a cylindrical wrapping path can be performed. As for wrapping a rectangular-shaped item, the wrapping path does not vary during the relative revolutions between the load L and the wrapper delivery unit 28. Therefore, the step of combining the information associated to the closed convex girths 64 can be omitted if wrapping is performed along a cylindrical wrapping path.

In case of a non-rectangular-shaped item and/or an at least partly helical wrapping path, the conversion of the closed convex girths 64, corresponding to the spaced-apart transverse cross-sections 60, into the wrapping path can take into account other process variables including a width and a type of the packaging material W that is going to be used for wrapping the load L. For instance, these data can be entered manually in the main control system by a process operator.

Simultaneously, other process parameters can be entered in the main control system including the force/elongation curve of the packaging material, the type of supporting tray, and the stiffness of the load L to be wrapped. These additional process parameters can be taken into account by the main control system during the wrapping process, as will be described in more details below.

Using the calculated wrapping path, the web pulling force as a function of an angular position of the wrapper delivery unit 28 with respect to the load L (or as a function of the ring 24 for a rotatable ring) is determined. Other variables can be taken into account when determining the web pulling force as a function of an angular position of the wrapper delivery unit 28 including, but without being limited to, the weight of the load, the friction values of the load L and the packaging material W, the position of the reel of wrapper 30 on the wrapper delivery unit 28 (or delivery unit frame, if any), the adhesiveness of the wrapper, and the like.

As the position of the wrapper delivery unit 28 with respect to the load L evolves during the wrapping process, the relative revolution speed between the load L and the wrapper delivery unit 28 is also supplied to the main control system. The main control system further derives the stretch of packaging material (or stretch ratio) as a function of the web pulling force. Thus, before beginning a wrapping process, the main controller has determined the length of packaging material and/or the packaging material force that has to be delivered to the load L as a function of the angular position of the wrapper delivery unit 28 during the wrapping process and the stretch ratio of the packaging material, if any, also as a function of the angular position of the wrapper delivery unit 28 during the wrapping process.

It is appreciated that cleaned imaging data, determining the closed convex girths 64, determining/calculating of the wrapping path and the web pulling force/stretch ratio as a function of an angular position of the wrapper delivery unit 28 can be performed by the same processor/control system. Thus, the image processing unit 42 and the main control system can be combined in a single control system/processor. Once again, this single control system/processor can be mounted to the wrapping apparatus 20 or located at a remote location. If it is mounted to the wrapping apparatus 20, it can be mounted to the frame 22 (or any other stationary part of the wrapping apparatus 20) or on the wrapper delivery unit 28, such as the rotatable ring 24 or any other rotatable part.

As mentioned above, the wrapping apparatus 20 comprises another control system and, more particularly, a wrapper delivery unit control system 38 (or wrapper delivery unit controller), as shown in FIG. 1. The wrapper delivery unit control system 38 is in data communication with the main control system (or the control system/processor for the main control system and the image processing unit 42). The wrapper delivery unit control system 38 controls the unwinding of the packaging material W and its stretching (if any). The wrapper delivery unit controller 38 is mounted to the wrapper delivery unit 28. In the embodiment shown it is mounted to the rotatable part and, more particularly, the rotatable ring 24, as shown in FIG. 1. In some implementations the wrapper delivery unit controller 38 is mounted to the delivery unit frame, if any, which in turn is mounted to the wrapper delivery apparatus 23, for instance mounted to the rotatable ring 24.

As mentioned above, the main control system, typically located on the stationary part of the wrapping apparatus 20, is in data communication with the wrapper delivery unit control system 38. More particularly, the main control system transfers the determined wrapping path, including its geometry, to the wrapper delivery unit control system 38 before a wrapping cycle. The main control system can also be responsible to count the rotations of the rotatable part (for instance, without being limitative, by following a position of one of the components mounted to the rotatable part such as the reel of packaging material 30 or by counting the teeth 25 on the rotatable part) or to derive the rotation of the rotatable part from the rotation of the motor driving the rotation and to stop the relative rotation between the rotatable part and the load L when a predetermined number of revolution(s) is reached and when the rotatable and the stationary parts are configured at the predetermined stationary position.

In some embodiments the wrapper delivery unit controller 38 can also be in data communication with the load transfer system controller (not shown). In some embodiments, such as the one shown, the load transfer system controller can be included in the main control system. The load transfer system controller controls the position of the loads along the wrapping line, i.e. the position/displacements of the loads L while they are scanned, their introduction into and withdrawal from the wrapping zone 27, and their displacement (either forward or rearward) during the wrapping process and inside the wrapping zone 27. During a wrapping cycle, the load transfer system controller controls the position of the load L. For a cylindrical wrapping, the load transfer system controls the position of the load during the wrapping cycle, i.e. how far the load L must be moved into the wrapping zone 27. For an helicoidal wrapping, the load transfer system controls the displacement of the load L during the wrapping cycle to create the predetermined wrapping path (or pattern).

Data communicated to the wrapper delivery unit controller 38 and the load transfer system controller can include the calculated wrapping path and web pulling force/stretch ratio as a function of an angular position of the wrapper delivery unit 28 during the wrapping process. In an embodiment the data transfer is carried out before starting a wrapping cycle for a load L, i.e. while no relative rotation between the load L and the wrapper delivery unit 28 is performed.

Wrapping is performed by engaging the load L and the wrapper delivery unit 28 in a relative rotation and unwinding the reel of packaging material 30 to deliver the amount of packaging material W. In some embodiments, such as a turntable, the load L is engaged in rotation while the wrapper delivery unit 28 remains stationary. In other embodiments, such as the horizontal wrapping apparatus shown in FIG. 1 and including the rotatable ring 24, the wrapper delivery unit 28 is engaged in rotation while the load L remains stationary, except for forward/rearward displacement along the conveying direction 45 during the wrapping process, i.e. no rotation about a rotation axis.

In some embodiments the web pulling force as a function of an angular position of the wrapper delivery unit 28 is controlled (a process variable, for example the length of film delivered to the load and/or the tension force in the film, is sensed and an actuator is varied in real time during the wrapping process) during the unwinding the reel of packaging material 30.

As mentioned above, in some embodiments the packaging material W can be stretched, i.e. it is applied in a stretched state onto the load L. In these embodiments the wrapper delivery unit 28 can include one or more stretch rollers 33. Stretch roller(s) 33 is/are driven stretch rollers in that they are powered to be engaged in rotation. The wrapper delivery unit 28 can include one or more DC servomotors (not shown), which are operatively connected to the one or more stretch rollers 33. For instance, DC power can be transferred to the one or more DC servomotors via slip rings or via inductive power transfer. The DC servomotors can be mounted to the rotatable ring 24, or the delivery unit frame, if any, adjacent to the stretch roller(s) 33. For instance, in the embodiment shown in FIG. 1 the wrapper delivery unit 28 includes only one stretch roller 33, operatively connected to and engaged in rotation by a servomotor (not shown).

As will be explained in more details below in reference to FIG. 6, due to corner variations which change the effective wrapping radius, such loads present a fluctuation in their demand for packaging material web when the packaging material web is wrapped around their periphery. More particularly, when a relative rotation is provided between the load and the wrapper delivery unit 28, the wrapper delivery unit 28 needs to accelerate or decelerate around the load corners to maintain a constant packaging material tension (or force) on the load.

Thus, it has been observed that, during a wrapping cycle, power consumption is irregular since the reel of packaging material 30 has to be accelerated and decelerated very quickly and the packaging material web force also varies quickly. Moreover, the net power consumption can be temporarily negative.

In an embodiment, the wrapper delivery unit 28 can also include capacitors 37 (and their appropriate electronics) mounted to the rotatable ring 24, as shown in FIG. 1. In some implementations the capacitors 37 are mounted to the delivery unit frame, if any, which in turn is mounted to the wrapper delivery apparatus 23, for instance mounted to the rotatable ring 24.

In an embodiment, when the rotatable ring 24 is not engaged in rotation, the capacitors 37 are recharged. There are several periods of time when the ring 24 is not engaged in rotation. These periods of time include, for instance and without being limitative, when the packaging material W is cut at the end of a wrapping cycle, when withdrawing a wrapped load from the wrapping zone 27 and introducing a new load to be wrapped into the wrapping zone 27, and while securing a free end of the packaging material web to the load at the beginning or at the end of a wrapping cycle. Each one of these actions requires a few seconds that can be used to charge the capacitors 37.

More particularly, the wrapping apparatus 20 is configured to end a wrapping cycle in a predetermined stationary configuration. The stationary part of the wrapping apparatus, for instance the frame 22, comprises electrical contact points (not shown) while the rotatable part of the wrapping apparatus 20 comprises complementary electrical contact points (not shown) in electrical communication with the capacitors 37. The complementary electrical contact points can be provided on the rotatable ring 24 or on the wrapper delivery unit 28, such as on the delivery unit frame, if any. In the predetermined stationary configuration, the electrical contact points on the stationary part of the wrapping apparatus 20 are in electrical contact with the complementary electrical contact points provided on the rotatable part of the wrapping apparatus 20. Capacitors require a DC charging current. Therefore, power transfer from the static part to the rotatable part can be done via DC current.

The DC power supplied to the capacitors 37 on the rotatable part can be used to power DC servomotors, controllers, sensors, and the like which are also mounted to the rotatable part, for instance mounted to the wrapper delivery apparatus 23, such as mounted to the rotatable ring 24 or to the wrapper delivery unit 28, such as mounted to the delivery unit frame, if any.

The capacitors 37 can be a part of a rotatable part power assembly which can also include a capacitor control system. As the capacitors 37, the capacitor control system can also be mounted to the rotatable part, for instance mounted to the wrapper delivery apparatus 23, such as mounted to the rotatable ring 24 or to the wrapper delivery unit 28, such as mounted to the delivery unit frame, if any. The capacitor control system can be used to control a charge state of each one of the capacitors 37 and the DC currents supplied to and fed by these capacitors 37. In some implementations the capacitor control system can be included in the wrapper delivery unit control system 38 or in the main control system, for instance.

It is appreciated that the configuration of the components mounted to the rotatable ring 24, directly or indirectly, such as the capacitors 37 and the wrapper delivery unit controller 38 can vary from the embodiment shown. For instance and without being limitative, the capacitors 37 and the wrapper delivery unit controller 38 can be mounted closer to the stretch roller 33, creating thereby enough free space on the rotatable ring 24 to receive one or more additional reel(s) of packaging material, including their wrapper delivery unit 28 for unwinding and stretching. By mounting two or more wrapper delivery units 28 to the wrapper delivery apparatus 23, for instance mounted to the rotatable ring 24, wrapping can be performed by two or more webs of packaging material simultaneously.

It is appreciated that the capacity of the capacitors 37 which can be included in the wrapping apparatus 20 depends, amongst others, on the size of the wrapping apparatus 20 and therefore on the amount of packaging material W to be delivered during the wrapping cycle. For instance, for a rotatable ring 24 having an inner diameter of 650 mm and a reel of packaging material 30 characterized by a 300 mm diameter and a 125 mm length, a total energy storage capacity of about 30 kJ is required to avoid a power outage in case of a succession of loads requiring intensive wrapping. Thus, the capacity of the capacitors 37 to be included in the wrapping apparatus 20 is determined by taking into account these apparatus parameters.

It is also appreciated that, in addition to power transfer between the stationary part and the rotatable part of the wrapping apparatus 20, the time periods in between wrapping cycles, i.e. when no relative rotation is provided between the load L and the wrapper delivery unit 28, can also be used to transfer data between data storage media located on the stationary part and the rotatable part of the wrapping apparatus 20, respectively.

As mentioned above, the wrapper reel receiving shaft 32, mounted to the wrapper delivery apparatus 23 and, more particularly, mounted to the rotatable ring 24 in the non-limitative embodiment shown, is designed to receive and support a reel of packaging material (or wrapper) 30. Thus, the wrapper reel receiving shaft 32 supports and carries the reel of packaging material 30 and is displaced, i.e. engaged in rotation about the horizontally-extending axis H, with the rotatable ring 24 and it rotates about its own axis simultaneously to dispense packaging material W. The rotation of the wrapper reel receiving shaft 32 about its rotation axis, and the simultaneous rotation of the reel of packaging material 30 mounted thereon, is driven by a reel servomotor 36.

In an embodiment the reel servomotor 36 is connected to the wrapper reel receiving shaft 32 using a power transmission such as a belt, a chain, a gearbox, a coupling and the like. The reel servomotor 36 and the wrapper reel receiving shaft 32 can extend substantially parallel to one another or at an oblique angle.

In another embodiment such as the one shown in FIG. 1, the wrapper reel receiving unit comprises the wrapper reel receiving shaft 32 and the reel servomotor 36. In such embodiment the wrapper reel receiving shaft 32 can be a hollow shaft and the reel servomotor 36 is received, at least partially, inside the central servomotor receiving cavity (i.e. a reel servomotor receiving cavity) of the hollow wrapper reel receiving shaft 32. Therefore, the reel servomotor 36 can either directly drive the wrapper reel receiving shaft 32 or indirectly through an inline gearbox (not shown).

In both embodiments the reel servomotor 36 accelerates and decelerates the relative rotation of the wrapper reel receiving shaft 32 and the reel of packaging material 30 depending on the length of packaging material that is required to wrap the load in an angular specific section of the path of the reel of packaging material 30 around the load L as calculated in the determined wrapping path. FIG. 6 shows that the required length of packaging material for different angular sections can vary significantly during the rotation of the wrapper delivery unit 28 around the load L. More particularly, FIG. 6 is a transverse cross-section of an item I supported by a supporting tray 50. While wrapping with a web of packaging material W, the wrapper delivery unit 28 including the reel of packaging material 30 moves together with the rotatable ring 24 from position 1 to position 2 and, then, to position 3. The angular movement of the rotatable ring 24 between position 1 and position 2 is about 60° and between position 2 and position 3 is also about 60°. However, while rotating from position 1 to position 2, the required length $l_1$ of packaging material W is very short in comparison with the packaging material length $l_2$ required when rotating from position 2 to position 3. Thus, when wrapping at high speed (for instance, about 2 to 3 revolutions of the rotatable ring 24 per second), the change of speed of the servomotor 36 driving the reel of packaging material 30 on the rotatable ring 24, is important when passing position 2. If the servomotor 36 fails to deliver the required length of packaging material in time, the packaging material W might break, if not the supporting tray 50 might bend upwards when the reel of packaging material 30 rotates beyond position 3.

Figure 6:
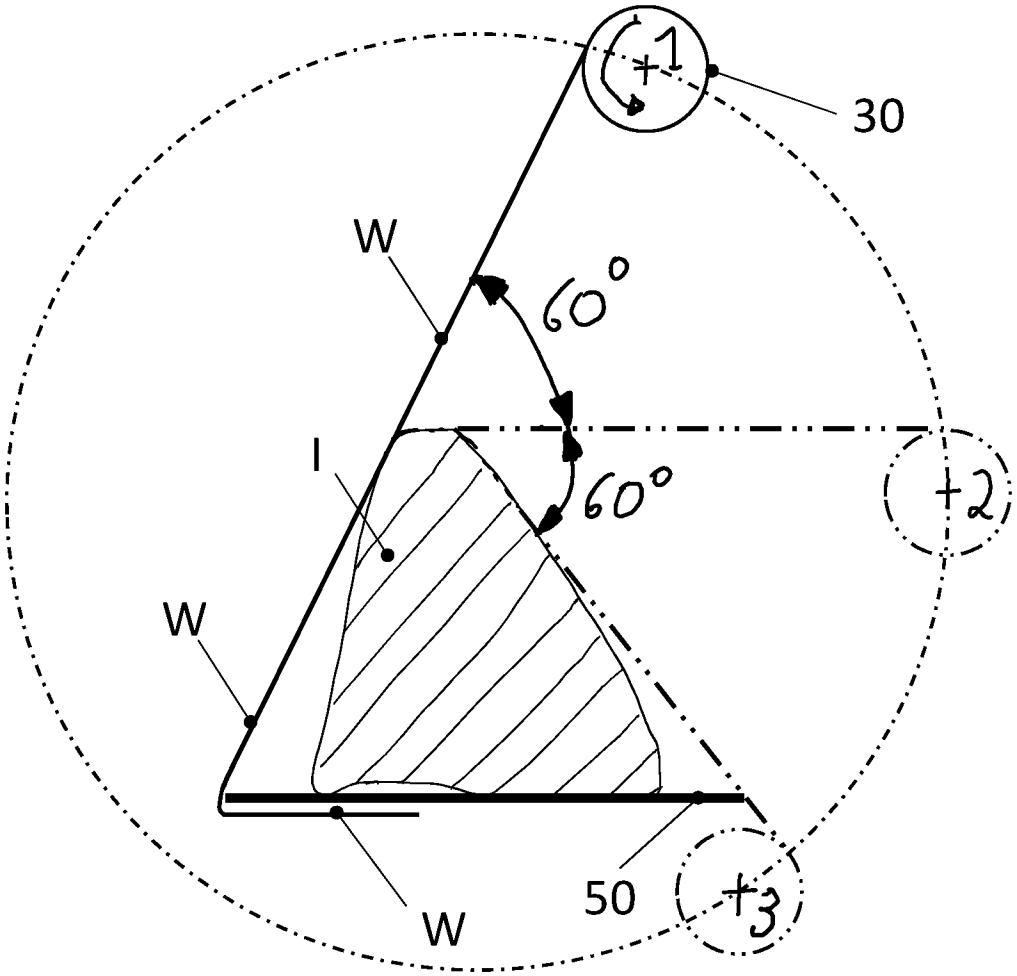
FIG. 6 illustrates is a schematic cross-section view of the load including the item supported on the supporting tray shown in FIG. 3 and including a length of packaging material for angular positions 1, 2, and 3.

Moreover, FIG. 6 shows that a physical length of the free web of packaging material is very variable along the circular path of the reel of packaging material 30 along the rotatable ring 24. This free web length is defined as a distance between the point of contact of the packaging material W with the load L and a last point of contact of the packaging material W with the wrapper delivery unit 28. For instance, the last point of contact of the packaging material W with the wrapper delivery unit 28 can be the reel of packaging material 30 if the wrapper delivery unit 28 is free of a stretch roller, additional rollers such as idle rollers, and dancer bar. If the wrapper delivery unit 28 includes at least one of a stretch roller, an additional roller and a dancer bar, the last point of contact of the packaging material W is a last contact point of the last of the components that the packaging material contacts before contacting the load L to be wrapped.

Thus, the point of contact with the last roller of the wrapper delivery unit 28 must be considered to calculate the free web length. For instance, in FIG. 6, for the purpose of the illustration, the wrapper delivery unit 28 is free of any stretch roller, dancer bar and additional idle rollers. In this embodiment the free web length is almost equal to a radius of a circular path of the reel of packaging material W in position 1, but is suddenly reduced to almost zero when passing position 3. Depending on the shape and position of the closed convex girth 64 relative to rotatable ring 24, the direction of rotation of the reel of packaging material 30 will have to be inverted suddenly to avoid a piece of free flapping packaging material W to be formed. Such a piece of free flapping packaging material could not only disturb the travel of the packaging material W through the wrapping apparatus 20, but also prevent obtaining the determined and desired packaging material wrapping force. The counter-clockwise direction of rotation indicated in position 1 in FIG. 6 is the most common direction of rotation for a rotatable ring 24 rotating in a clockwise direction. The actual direction is determined by the main control system. As a consequence apart from the requirement to be highly dynamic, the reel actuator, such as the servomotor 36, driving the reel of packaging material 30 and the stretch roller actuator, such as a stretch roller servomotor, driving the stretch roller if any, must be able to operate in the four quadrants: two directions of rotation (clockwise and counter-clockwise) combined with acceleration and deceleration. This four-quadrant operation implies a bidirectional energy transfer, e.g. to and from the electric power (energy supply), such as capacitors 37.

Figure 7:
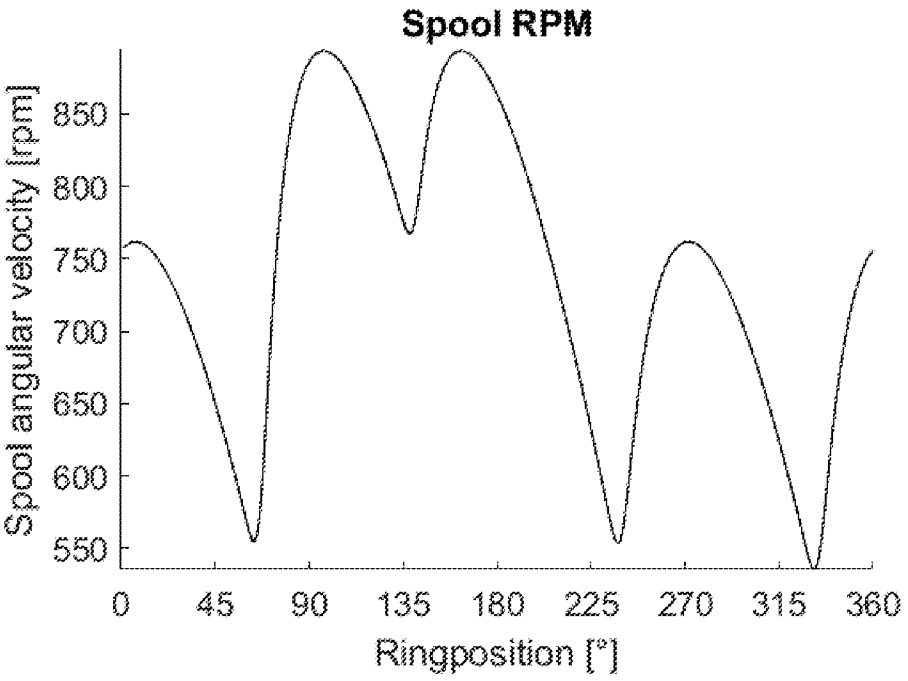
FIG. 7 is a graph showing a required relative angular speed of a reel of packaging material as a function of the position of a wrapper delivery unit relative to a load to be wrapped with a rotatable ring rotating at a constant speed around the load.

Therefore, at angular positions of the wrapper delivery unit 28, the rotation speed of the reel of packaging material 30 with respect to the rotation speed of the rotatable part (hereinafter referred to as the "relative angular speed of the reel of packaging material 30") has to increase suddenly. For the purpose of illustration, FIG. 7 shows a graph of the required relative angular speed of the reel of packaging material 30 (i.e. spool angular velocity in rpm) as a function of the position of the wrapper delivery unit 28 relative to the load L (i.e. ring position along 360 degrees), assuming that the rotatable ring 24 rotates at a constant speed about its axis H and around the load L.

For many loads L, three to four windings, i.e. revolutions of the wrapper delivery unit 28 around the load L, suffice to secure the items on the supporting tray 50 and to bundle the items together.

In some embodiments the rotatable ring 24 can rotate at a speed up to 180 or 240 revolutions/minute, meaning that the three to four windings can take less than two seconds. Since the rotatable ring 24 has to start from standstill and has to stop after the windings, the angular speed of the rotatable ring 24 will vary while wrapping the windings. Therefore, the required changes of the relative angular speed of the reel of packaging material 30 can even be faster than the ones indicated in FIG. 7, creating even higher accelerations/decelerations in the packaging material demand/supply. These high accelerations/decelerations require a control system, i.e. the wrapper delivery unit controller 38, supplied with an accurate knowledge of the real time angular position of the wrapper delivery unit 28 mounted to the rotatable ring 24 and, more particularly, of the reel of packaging material 30 and/or the last point of contact of the packaging material W with the wrapper delivery unit 28. As mentioned above, the wrapper delivery unit controller 38 is mounted to the wrapper delivery apparatus 23 and, more particularly, mounted to the rotatable ring 24 in the non-limitative embodiment shown and, in some implementations, is operatively connected to the reel servomotor 36, which drives the wrapper reel receiving shaft 32 that carries the reel of packaging material 30. More particularly, the wrapper delivery unit controller 38 controls a rotation speed of the reel servomotor 36.

It has been observed that measuring the angular position of the wrapper delivery unit 28 using a sensor (not shown) mounted to the frame 22 of the wrapping apparatus 20 is possible. However, transfer of the monitored position data to the wrapper delivery unit controller 38, e.g. via WiFi or Bluetooth or another communication protocol, may not be fast enough for the required accuracy of the system that controls the wrapper delivery. Therefore, the angular position of the wrapper delivery unit 28 is monitored using an angular position sensor 39 mounted to the rotatable part and, more particularly, to the rotatable ring 24, as shown in FIG. 1. In some implementations the angular position sensor 39 is mounted to the delivery unit frame, if any, which in turn is mounted to the wrapper delivery apparatus 23, for instance mounted to the rotatable ring 24.

In one possible embodiment the angular position sensor 39 can be an optical sensor or a gyroscope, also known as angular rate (or velocity) sensor, which is in data communication with the wrapper delivery unit controller 38 which in turn is in data communication with the reel servomotor 36 to control same. More particularly, the angular position sensor 39 measures a real time angular position of the rotatable ring 24. In some embodiments the angular position of the delivery apparatus can be measured by using a sensor system partly mounted on the fixed part of the machine, e.g. a simple photocell or magnetic sensor counting teeth of the belt pulley on the delivery apparatus.

The optical sensor, which is mounted on the rotatable part, can be configured to read marks or markers, such as magnetic markers, on the stationary part of the wrapping apparatus.

Furthermore, the real time rotational inertia and the real time diameter of the reel of packaging material 30 can be supplied to the wrapper delivery unit controller 38 and taken into account to control the rotation speed of the reel servomotor 36 and, thereby, the real time packaging material delivery speed.

The real time diameter of the reel of packaging material 30 can be measured or calculated. To obtain a specific linear speed of the packaging material, the required angular speed of the reel of packaging material 30 depends on its actual outer diameter, which varies during a wrapping cycle. For instance, in some embodiments, the outer diameter of the reel of packaging material 30 can decrease from about 300 mm for a new reel of packaging material to about 90 mm for a depleted ("empty") reel of packaging material 30, creating a change of the angular speed by a factor 3.33. The rotation inertial is proportional to the square value of the outer diameter. For this particular embodiment the rotational inertia decreases by a factor 11, while the rotational speed is 3.33 times higher to obtain the required web speed. These variations in the rotational inertia and the diameter of the reel of packaging material 30 confirm the requirement for a fast dynamic drive, which can be obtained through the use of the reel servomotor 36 and, more particularly, when the reel servomotor 36 is inserted in the wrapper reel receiving shaft 32.

As mentioned above, DC power can be provided on the wrapper delivery apparatus 23, such as mounted to the rotatable ring 24, through the capacitors 37, for instance. Therefore, in a non-limitative embodiment, the reel servomotor 36 can comprise a brushless DC motor having a series of coils on its stator, located at the inner part of the motor, and permanent magnets at the inner side of its rotor, i.e. the outside part of the motor, also referred to as outrunner motor or a motor having a rotating ring, instead of a rotating shaft. When operating the wrapper delivery unit 28 in the four-quadrant operation (two directions of rotation combined with acceleration and deceleration), as explained above, brushless DC motor(s) makes the four-quadrant steering highly dynamic.

In some embodiments the packaging material W can be stretched, meaning that the stretched state when applied onto the load L is created in at least two steps. In these embodiments the wrapper delivery unit 28 can include one or more stretch rollers 33 to pre-stretch the packaging material W. The stretch roller(s) 33 is (are) mounted to the wrapper delivery apparatus 23 and, more particularly, mounted to the rotatable ring 24 in the non-limitative embodiment shown, and their outer peripheral surface can be covered by a high friction material or coating to avoid slippage of the packaging material web W relative to the outer surface of the stretch roller(s) 33. As known in the art, additional rollers, such as the idle rollers 34*a*, 34*b*, can be mounted to the wrapper delivery apparatus 23 and, more particularly, mounted to the rotatable ring 24 in the non-limitative embodiment shown, in a configuration to increase the contact angle of the packaging material web W with the stretch roller(s) 33 and/or to increase the contact pressure between the packaging material web W and the stretch roller(s) 33. These additional rollers can be idle rollers or they can be driven with the same circumferential speed as the stretch roller(s) 33. The packaging material W can be stretched between its point of release from the reel of packaging material 30 and a first one of the stretch roller(s) 33, downstream of the reel of packaging material 30, if the circumferential speed of the first stretch roller 33*a* is higher than the circumferential speed of an outer layer of packaging material on the reel 30.

In some embodiments the stretch ratio can be fixed. Therefore, the ratio between the angular speed of the reel of packaging material 30 and the angular speed of the stretch roller 33 varies with the diameter of the reel of packaging material 30 mounted to the wrapper reel receiving shaft 32. Therefore, the use of a power transmission, such as gears between the wrapper reel receiving shaft 32 and the stretch roller 33, is not possible for an accurate control. In an embodiment the wrapper delivery unit 28 comprises an additional servomotor, i.e. a stretch roller servomotor, used to drive the stretch roller 33. As for the reel servomotor 36, it can be operatively connected to the stretch roller 33 using a power transmission, such as a belt, a chain, a gearbox, a coupling and the like, or it can be located inside the stretch roller 33 to directly engage the stretch roller in rotation. Once again, as DC power can be provided on the wrapper delivery apparatus 23 and, more particularly, on the rotatable ring 24 in the non-limitative embodiment shown, through the capacitors 37, for instance, in a non-limitative embodiment, the stretch roller servomotor can be a DC motor and, more particularly, a brushless DC motor.

In another embodiment, as for the wrapper reel receiving unit including the hollow wrapper reel receiving shaft 32 and the reel servomotor 36 is received at least partially therein, the stretch roller servomotor can be at least partially inside the stretch roller 33, inside a roller servomotor receiving cavity, as described above in reference to an embodiment of the reel servomotor 36, to directly drive the stretch roller 33. Alternatively, the stretch roller servomotor and the stretch roller 33 can be drivingly engaged through an inline gearbox (not shown).

In an embodiment the wrapper delivery unit comprises a single stretch roller, which can be power driven. If the single (or sole) stretch roller 33 and the wrapper reel receiving shaft 32 are powered, for instance via servomotors, the packaging material W is stretched between the wrapper reel receiving shaft 32 and the single stretch roller 33.

Attachment/fixation of the packaging material W to the load L at the beginning of the wrapping cycle, cutting the packaging material W at the end of the wrapping cycle, and maintaining the tail of the packaging material W ready for the next wrapping cycle is known in the art and can be applied to horizontal wrapping apparatus such as the one shown in FIG. 1.

As mentioned above, in some embodiments the packaging material is a plastic-based film having a "cling" side and therefore, it will adhere automatically to other materials including the load and another section of packaging material. Therefore, conventional techniques for attachment/fixation to the load L at the beginning and at the end of the wrapping cycle can be applied.

In some embodiments the packaging material is paper-based and, more particularly, a stretchable paper, also referred to as a flexible paper or a highly deformable paper. Stretchable paper includes cellulose-based films that can be stretched from about 10% to about 30% depending on the environmental conditions which are also characterized by a high energy absorption when deformed. In comparison with stretchable plastic-based wrap films, longitudinal contraction after releasing the pulling force is often limited to about 5% of the unstretched length. A conventional stretchable paper can have a thickness ranging between about 50 to about 400 g/m$^2$ (grams/square meter). For instance and without being limitative, a typical thickness for wrapping a typical load with an horizontal stretch wrapping machine, the thickness can range between about 75 g/m$^2$ and about 125 g/m$^2$.

Figure 8:
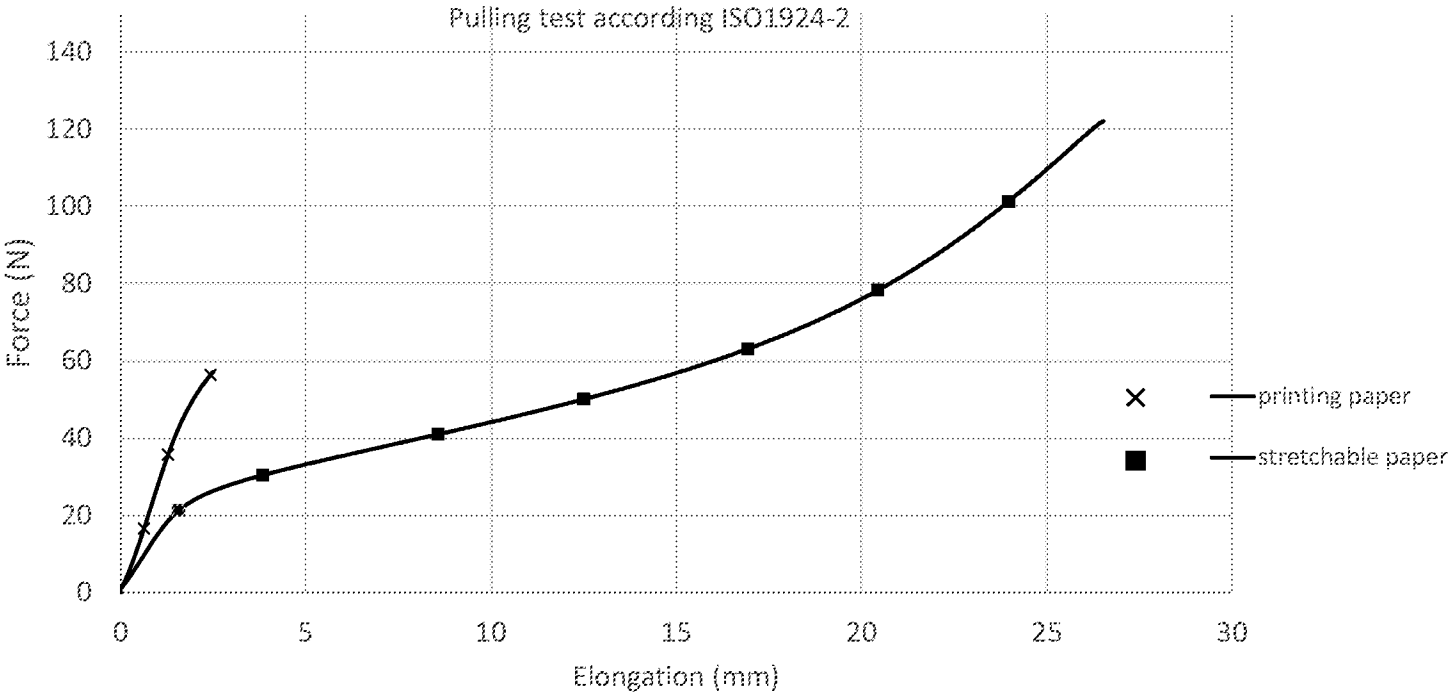
FIG. 8 is a graph showing elongation in mm versus a pulling force applied to a conventional printing paper and a stretchable paper.
Figure 9:
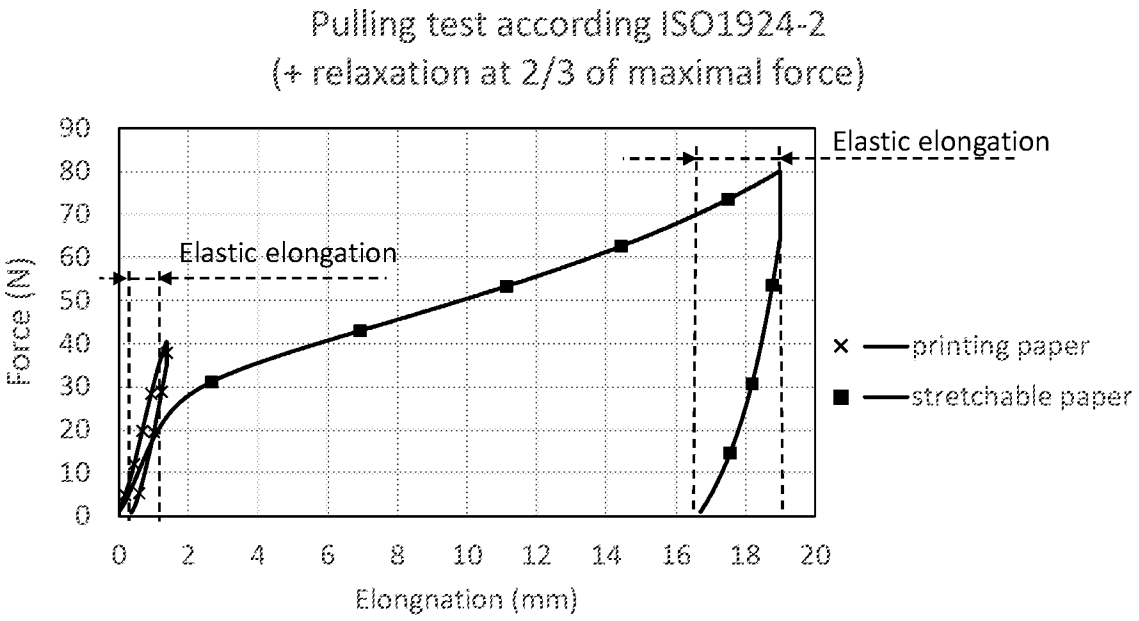
FIG. 9 is a graph showing contraction curve at ⅔ of a breaking force for a conventional printing paper and a stretchable paper.
Figure 10:
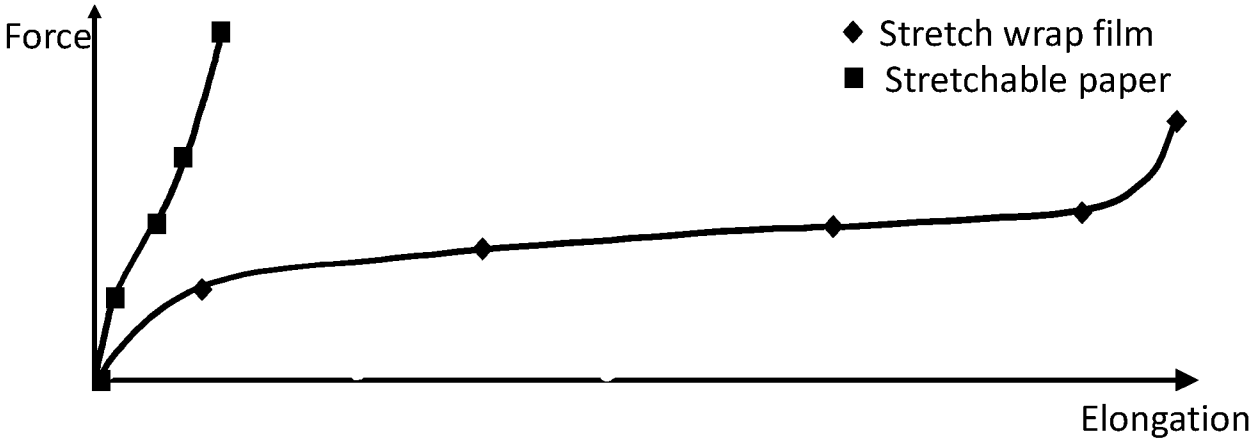
FIG. 10 is a graph showing elongation in mm versus a pulling force applied to a plastic-based packaging material (HDPE) and a stretchable paper used as packaging material.

FIG. 8 is a graph comparing force—elongation curves of a conventional high quality printing paper and a stretchable paper according to the common ISO 1924-2 standard. Samples of both packaging materials have a width of 15 mm and are cut from 100 g/m$^2$ paper. A free length of the samples is about 180 mm. Table 1, below, details the properties of the stretchable paper that was used for testing and for which results are shown in FIGS. 8 to 10.

TABLE 1

Properties of a non-limitative embodiment of stretchable paper.

| Property | Unit | | | Method |
|---|---|---|---|---|
| Grammage | g/m$^2$ | | 100 | ISO 536 |
| Caliper | μm | | 140 | ISO 536 |
| Stretch | % | MD | 14 | ISO 1924-3 |
| | % | CD | 10 | |
| Tensile | kN/m | MD | 9.0 | ISO 1924-3 |
| strength | kN/m | CD | 4.5 | |
| Tear | mN | MD | 1300 | ISO 1974 |
| strength | mN | CD | 1800 | |
| TEA | J/m$^2$ | MD | 600 | ISO 1924-3 |
| | | CD | 340 | |
| Roughness | ml/min | WS | 1000 | ISO 8791/2 |
| Brightness | % | | 84 | ISO 2470 |
| Moisture | % | | 7 | ISO 287 |

The curves show that the ultimate breaking force for stretchable paper is more than the double of the corresponding force for printing paper (122 N versus 58 N) and that the elongation is about 10 times higher for stretchable paper compared to printing paper. Paper types capable of elongating or stretching more than 10% before failure in this standard test can be classified as stretchable paper. Depending on the quality of the stretchable paper, the spread on the curves of distinctive samples can be up to 5% but in most cases this spread is less than 2%, meaning that the relation between force and elongation can be used in the control algorithm for wrapping a load using stretchable paper as packaging material.

FIG. 9 provides an indication of the elastic behaviour of stretchable paper compared to printing paper used as packaging materials. When reducing the pulling force on a test sample of packaging material before breakage, the packaging material contracts in longitudinal direction of the sample. In case of printing paper, this contraction (identified as "elastic elongation" in FIG. 9) is negligible and often smaller than the deformation of the load being wrapped and the board. If an item is wrapped on a supporting tray, such as a piece of cardboard, using a printing paper, the item will most likely slide on the supporting tray, the paper used as packaging material will tear during manipulation afterwards or the cardboard used as supporting tray will bend during wrapping. In case of stretchable paper, as defined above, the contraction, i.e. the elastic elongation, is small in relative figures (between 5 and 15% of the original stretch) but not negligible in absolute figures, meaning that the items are pushed on the cardboard used as supporting tray when stretchable paper is used for wrapping items or items are pressed against each other when stretchable paper is used to bundle items by wrapping.

FIG. 10 shows the difference between a typical stretched plastic-based packaging material (or wrap film) (HDPE) and stretchable paper, as defined above, used as packaging materials. While the stretched wrap film can be stretched up to about 300 or even about 500% before breaking, the stretchable paper breaks, when being used as a wrapper, at a stretch of about 10 to about 20%, for some exceptional stretchable paper type at about 50%. The curve of stretched plastic-based wrap film shows a so-called plateau value, meaning that the force does not increase significantly between a stretch of about 20% to about 300-500%. As a consequence, it is relatively easy to wrap a load using stretched plastic-based wrap film. More particularly, wrapping can be performed using a wrapping apparatus comprising a rather basic control system. Long profiles can even be bundled in conventional wrapping machines, which are free of an active control system to unwind the reel of stretched plastic-based film. On the contrary, the curve of stretchable paper shows that the required length of paper must be delivered very accurately to avoid loose wrapping and breaking of the stretchable paper. This implies that the closed convex girths 64 must be determined beforehand, that the angular position of the rotatable ring must be measured in real time, and that a highly dynamic configuration of a reel unwinding system should to be used.

Thus, in the embodiments wherein the packaging material includes stretchable paper, a specific gripper (or clamp), an adhesive, such as glue, and a cutting tool are used in between two consecutive wrapping cycles to attach/fix the stretchable paper to the load L at the beginning of the wrapping cycle, cutting the stretchable paper at the end of the wrapping cycle, and maintaining the tail of the stretchable paper ready for the next wrapping cycle.

In one embodiment the strip of paper intended to be wrapped is clamped. Clamping can be squeezing between two mechanical parts by mechanical, magnetic or other forces or kept near a single mechanical part by means of air pressure differences or other. The strip of paper is preferably clamped near its end. An adhesive is put on the strip of paper near the clamp and/or on the bottom of the corrugated board. In a preferred embodiment, the strip of paper and the corrugated are joined by means of the adhesive by moving the clamp towards the corrugated. In an alternative embodiment an additional mechanical element is used to join the strip of paper and the corrugated. The clamp is than released and moved away. When the wrapping operation of a load is completed, the wrapper delivery unit is stopped. The angular position of the wrapper delivery unit during this stop is in this case preferably chosen to create an angle between about 100° and about 50° between the free web of paper and the bottom plane of the corrugated board. This means the web of paper touches the edge of the corrugated board. An adhesive is applied to either the web of paper, the bottom of the corrugated board or a strip of paper wrapped on the corrugated board during previous revolutions. The free web is clamped and joined with the bottom of the load. The web of paper is cut near the joint, keeping the web of paper clamped on the opposite side of the cut, meaning that the web of paper is cut in between the part of the web that is clamped and the part of the web that is joint to the load. It is understood that the control system of the wrapping apparatus keeps the tension in the web of film until the joint is created. The tension is reduced prior to cutting or during cutting of the web of paper.

Figure 11:
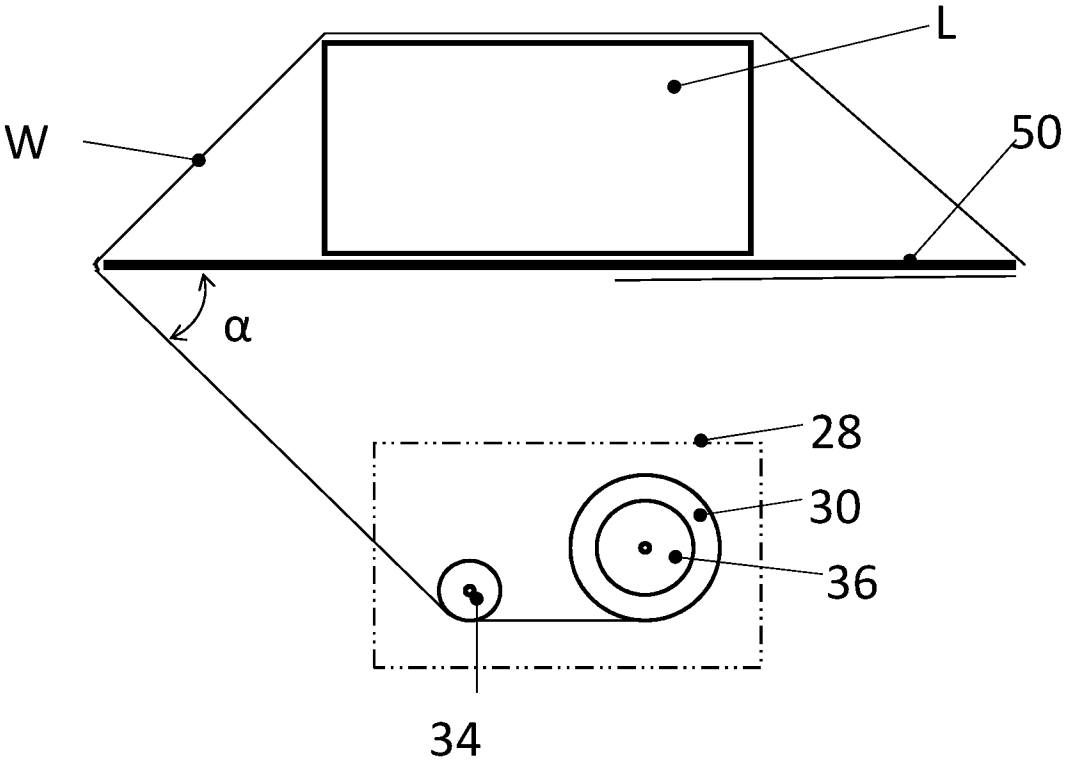
FIG. 11 is a schematic representation of the wrapper delivery unit rotatable around the load.

At the end of a wrapping cycle, rotation of the rotatable ring 24 and the wrapper delivery unit 28 carrying the reel of paper are stopped in the predetermined stationary configuration, as explained above. The predetermined stationary configuration is selected to correspond to a position wherein a free web of paper between the reel of stretchable paper and the load L is underneath the supporting tray 50 of said load L at an angle $\alpha$ that is determined by design and can be between about 15° and about 160° as shown in FIG. 11, and in a particular embodiment it is between about 75° and to about 90°. It is appreciated that the angle $\alpha$ depends, amongst others, on a width of the supporting tray 50. In some embodiments the predetermined stationary configuration is fixed and determined by the electrical contact points of the frame 22 and the complementary electrical contact points on the rotatable part, which in turn are in electrical communication with the capacitors 37. The free web of stretchable paper is clamped, adhesive is applied to an adhesive-receiving surface of the web of stretchable paper near the gripper and, more particularly, between the gripper and the load L, the surface of the stretchable paper that carries the adhesive is then pushed against the underside of the load L and then the web of paper is cut. In a non-limitative embodiment the surface of the stretchable paper that carries the adhesive is bonded and, more particularly, glued on a previous revolution of the stretchable paper or on the supporting tray 50, if any.

In some embodiments, when the packaging material W is a stretchable paper, the wrapper delivery unit 28 can be free of stretch rollers. For instance, the stretchable paper supplied from the reel of packaging material 30 can be directed directly to one or more idler roller(s) and exit the wrapper delivery unit 28 without being stretched via driven stretch roller(s). In some embodiments the wrapper delivery unit 28 can further include non-driven rollers to create roping on one or both side of the web of packaging material W, if needed.

The wrapped load is then transferred out of the wrapping zone 27 and the next load to be wrapped is introduced in the wrapping zone 27. Once again, adhesive is applied to a tail adhesive-receiving area of the web near the gripper and, more particularly, between the gripper and the reel of paper. Then, the tail area that carries the adhesive is pushed against the underside of the load L. Relative rotation between the load L and the wrapper delivery unit 28 can start as soon as the adhesive is cured, i.e. that the packaging material is secured to the load L. The adhesive can be selected to require a relatively pressure and have a relative fast curing time. Thus, in some specific cases, one or both free edges of the packaging material, such as stretchable paper, can even be glued to the load, either on the supporting tray 50 or on the item(s) itself (themselves).

In some embodiments the standstill time period of the rotatable ring 24 of the wrapping apparatus 20, i.e. the time wherein there is no relative rotation between the load and the wrapper delivery unit 28, can be as short as 3 seconds when using stretchable paper and 1 second when using stretch film. As mentioned above, this standstill/stationary period of time can be used to recharge the capacitors 37 of the wrapper delivery unit 28 and/or transfer data between the stationary and the rotatable parts of the wrapping apparatus 20.

As mentioned above, in some embodiments, to protect items I during manipulation and transport, free space between the items I and a container, such as a box, is desired. It is proposed in this invention to provide a gap of air between the product and the outside box not on five sides as in the prior art solutions, but on all six sides, i.e. also underneath the supporting tray. Doing so is definitely advantageous in case of items sensitive to shocks, like e.g. items containing electronics, containing glass or ceramics or other fragile materials. To create a free spacing underneath the items I, the supporting tray 50 can be folded along folding lines, thus creating legs 80 (FIG. 12) extending downwardly and abutting against a wall of the container and maintaining the portion of the supporting tray 50 that supports the items I spaced-apart from the container walls.

In some implementations the supporting tray 50 is made of cardboard and, more particularly, corrugated cardboard (or fibre board) including a fluted corrugated sheet (also known as medium) sandwiched between two linerboards. In some particular embodiments the corrugated cardboard comprises only one linerboard bonded to the fluted corrugated sheet. For practical reasons related to the machinery, the folding lines typically extend parallel to the flutes of the corrugated cardboard, limiting thereby the bending stiffness of the portion of the corrugated cardboard between the legs 80. If the items I supported by the supporting tray 50 are heavy, the corrugated cardboard may bend under the item weight and the items might be in indirect contact with the bottom of the container, i.e. through the portion of the corrugated cardboard between the legs 80 that contacts the container wall. The bending of the supporting tray 50 can be avoided by wrapping the items on a flat supporting tray.

Figure 13:
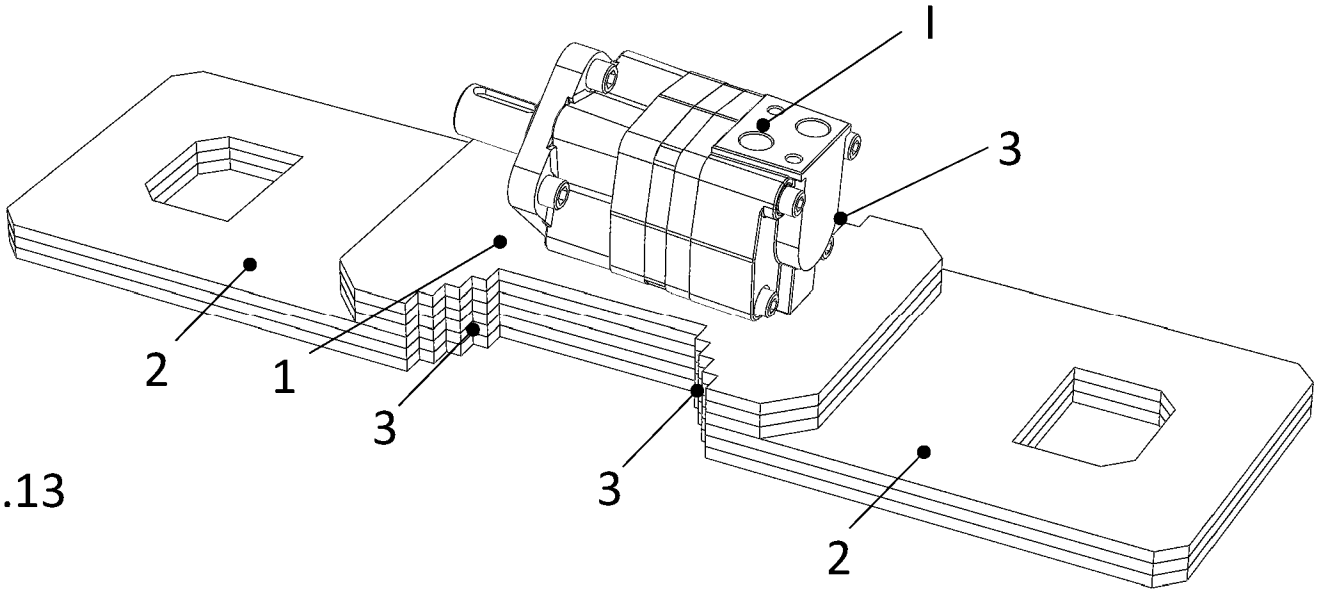
FIG. 13 illustrates an item on a supporting tray provided with a trapezium-shaped cut having a stepwise decreasing width towards the inner side of the tray.

In an embodiment the 3D load comprises a supporting tray, which can consist of superposed boards. For instance, the superposed boards can comprise corrugated cardboards, wherein flutes of a first one of the corrugated cardboard are oriented in an orthogonal direction to flutes of a second one of the corrugated cardboards. The superposed boards may define a stack of boards, wherein the stack comprises an item supporting portion and outer (i.e. non-supporting) portions. The thickness of the item supporting portion, measured along the stacking direction and substantially defined by the number of boards or layers of the stack, may be larger than the thickness of the outer non-supporting portions. The stack further comprises a first and a second major outer surface defined by an upper and bottom board of the stack, respectively, and side surfaces (disposed between the first and second major outer surface). According to embodiments of the present invention, opposing side walls may comprise trapezium-shaped cut-out portions extending along the item supporting portion of the stack, having an stepwise inwardly decreasing length, wherein said length is measured in a direction parallel to the opposing side walls. The minimum remaining width in between the two cut-out portions may be predefined depending on the width of the item to be wrapped. These trapezium-shaped cut-out portions extending over at least a part of the item supporting portion of the stack are beneficial for reducing or even completely eliminating the risk of the packaging material slipping away during the wrapping process. In FIG. 13 an illustration is provided, wherein a single item, e.g. a heavy motor, on a rectangular shaped tray consisting of a stack of superposed boards is to be wrapped. An item supporting portion (1) and two outer portions (2) are shown. The item supporting portion is thicker than the outer portions. Two opposing side walls between the upper and bottom board of the stack are provided with a trapezium shaped cut-out (3). The cut-out is in general particularly useful for heavy slippery items. Indeed, if the tray is wider than the heavy item to be wrapped, the tray is folded upwards under the high forces of the tensioned packaging material. If a part of the supporting portion of the tray and the item have substantially the same width, the tension force in the wrapper can be very high without significantly deforming the tray. By additionally giving the cut-out a stepped shape, it can be ensured the item is kept fixed in its position during and after the wrapping, as the packaging material is prevented from slipping due to the specific shape of the cut-out.

Returning to FIG. 5, there is shown an embodiment of an item I supported on a supporting tray 50 made of a piece of corrugated cardboard. The flutes of the corrugated cardboard extend parallel to the transverse direction, i.e. in a direction perpendicular to the conveying direction 45, thereby creating a relatively high resistance to the pulling forces of the packaging material web W. When applied to the load L, the packaging material web W automatically takes the shape of the closed convex girths 64 of the item I on the supporting tray 50, i.e. of the load. In an embodiment wherein stretchable paper is used as a packaging material, one free end 70 of the web of stretchable paper is attached (bonded) to the lower surface 56 of the supporting tray 50 before starting the wrapping process. As mentioned above, the other free end of the packaging material web, at the end of the wrapping process, can be attached (bonded) to a previous revolution (winding) of the packaging material web W or directly to the supporting tray 50. Furthermore, in some specific embodiments one or both free edges of the packaging material W can even be attached (bonded) to the load L, including the item(s) I.

Figure 12:
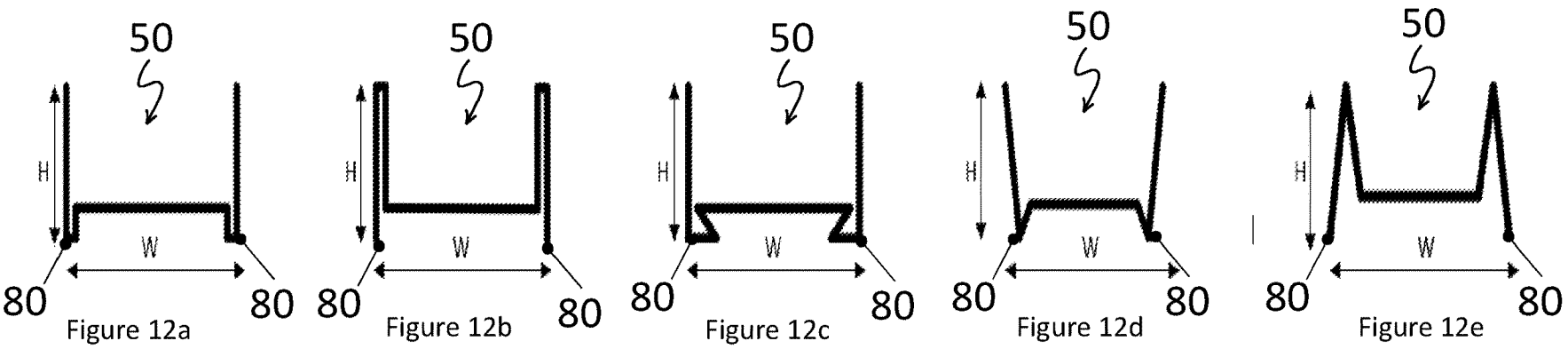
FIG. 12 includes FIGS. 12*a*, 12*b*, 12*c*, 12*d*, and 12*e* which are schematic front elevation views of a supporting tray folded along fold lines to provide a spacing between the load supporting portion of the supporting tray and a bottom wall of a container.

FIG. 12 shows non-limitative examples of supporting tray 50 folding after wrapping one or more items I on it. If the supporting tray 50 is made of corrugated cardboard, the flutes of the cardboard extend parallel to the folding lines defining the legs, meaning that the cardboard can bend downwards in case of heavy items in combination with a long distance between the legs 80. To prevent bending, the supporting tray 50 can include a second piece of corrugated cardboard or a piece of honeycomb panel or the like, superposed on top of the piece of corrugated cardboard shown in FIG. 5, for instance. In an embodiment shown in FIG. 14, the supporting tray 50 comprises two pieces of superposed corrugated cardboard 82, 84. More particularly, the flutes of the second piece of corrugated cardboard 82, i.e. the upper one and the one in contact with the item I, extend normal to the flutes of the first piece of corrugated cardboard 84, i.e. the lower one. The items I can be wrapped on this second board piece 82, which can be made of corrugated cardboard, honeycomb panel and the like, beforehand or the items I can just be put on this second board piece 82 and wrapped as an assembly with the first board piece 84 depending on the density and the friction of the item(s) I being wrapped. In this non-limitative embodiment, a single revolution of a relatively wide web of packaging material W around the load L was required and the wrapped load L included the two superposed boards 82, 84. In other embodiments (not shown) a higher number of revolutions of packaging material W can be used to wrap the load L. Furthermore, the web of packaging material W can be narrower or wider than the items I being wrapped. In addition, the items can be wrapped first on the upper one 82 of the superposed boards 82, 84. Then, the assembly including the item I and the upper one 82 of the superposed boards 82, 84 can be mounted to the lower one 84 of the superposed boards 82, 84 and a second wrapping can be performed on the assembly.

Figure 15:
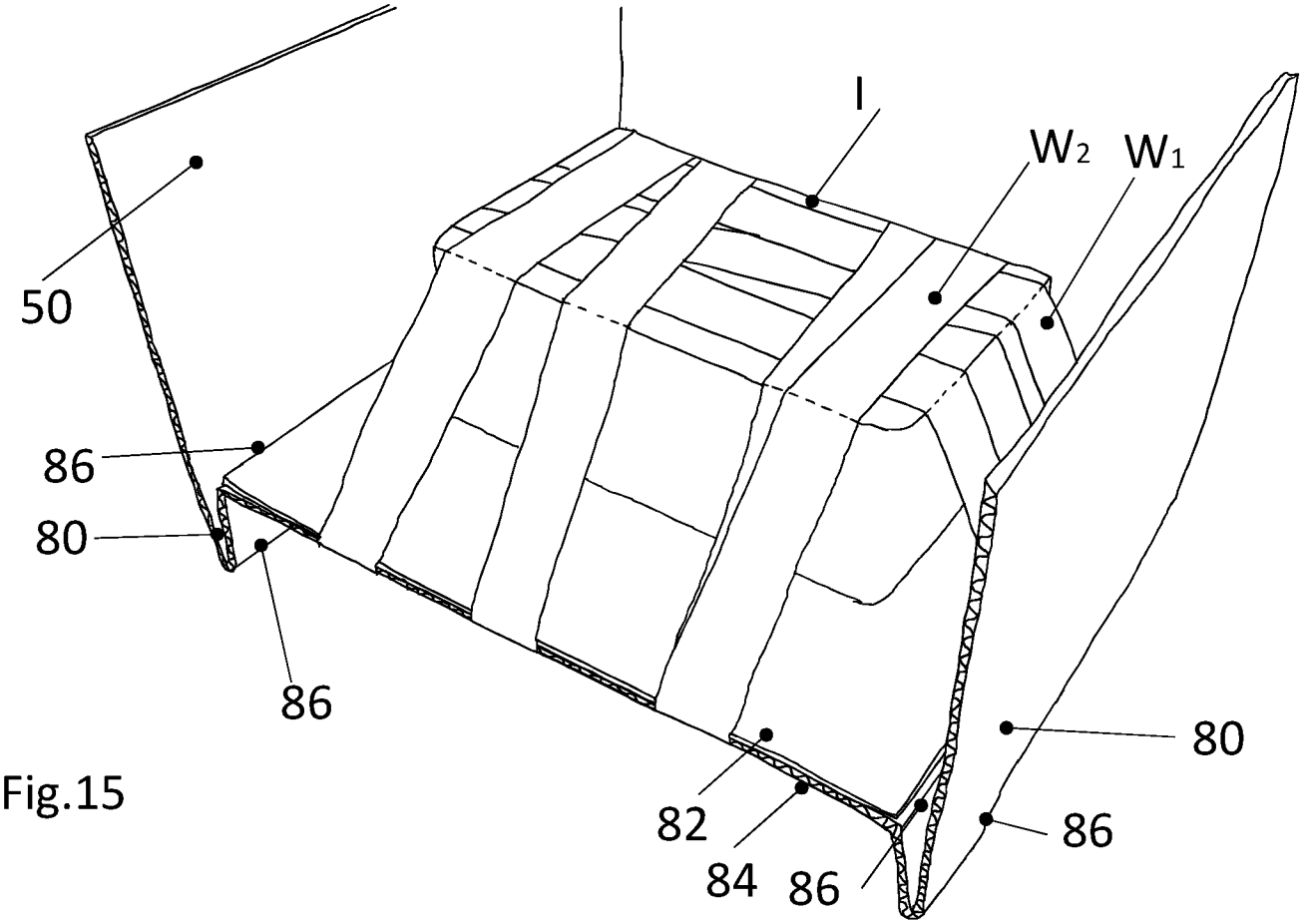
FIG. 15 is a perspective view of a wrapped load supported on a supporting tray including two layers of corrugated cardboard wherein flutes of the two corrugated cardboard layers are oriented in orthogonal directions and wrapped with two webs of packaging material oriented in perpendicular directions.

Thus, in the embodiment shown in FIG. 15, the item I is wrapped on two pieces of corrugated cardboard 82, 84, forming the supporting tray 50, when leaving the wrapping apparatus 20 and before folding the lower one 84 of the corrugated cardboard pieces. The flutes of this lower one 84 of the corrugated cardboard pieces extend parallel to the transverse cross-sections and parallel to a plane of the rotatable ring 24 of the wrapping apparatus 20. The flutes of the optional upper one 82 of the corrugated cardboard pieces extend perpendicular to the flutes of the lower one 84 of the corrugated cardboard pieces. As will be described in more details below, two wrapping cycles have been performed to obtain the wrapped load and for each one of the wrapping cycles, more than one revolution of packaging material (or winding) has been applied to the load L. Since the web of packaging material W is narrower than the items being wrapped, the wrapping process was performed while the supporting tray 50 carrying the items I was displaced along the conveying direction 45 in the wrapping apparatus 20, thus creating a (partly) helicoidal winding of the packaging material W around the load L.

Figure 14:
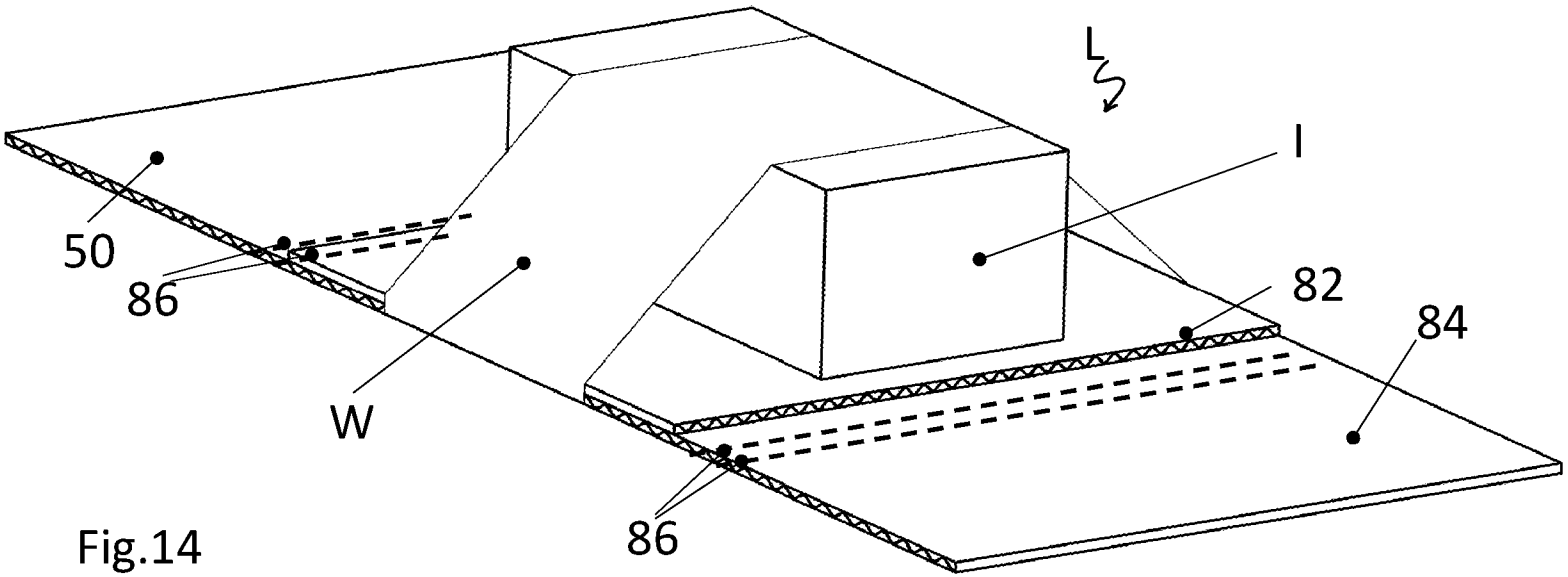
FIG. 14 is a perspective view of a wrapped load supported on a supporting tray including two layers of corrugated cardboard wherein flutes of the two corrugated cardboard layers are oriented in orthogonal directions.

In the non-limitative embodiments shown in FIGS. 14 and 15, the lower one 84 of the corrugated cardboard pieces is longer than the upper one 82 and includes lines 86 for optional folding.

When fed to the wrapping apparatus 20 for a wrapping cycle, the load L is orientated in a manner such that the flutes of a corrugated cardboard used as a supporting tray 50 (or the an upper one 82 of the corrugated cardboards if the supporting tray includes two or more boards) are in the transverse direction, meaning that the windings of the packaging material W are applied almost parallel to the flutes. In other words, the flutes of the corrugated cardboard extend substantially normal to the conveying direction 45 defined by the load transfer system 26. Thus, a high resistance to the pulling forces of the packaging material W is created by the orientation of the flutes with respect to the packaging material W. When wrapped, the packaging material W automatically takes the shape of the closed convex girths 64 of the item(s) I on the supporting tray 50, as explained above. Once inserted in the wrapping apparatus 20, the load L is wrapped for a first wrapping cycle.

If the final wrapped load includes superposed boards for the supporting tray 50, at the end of a first wrapping cycle, the wrapped load supported by the first board 82, which can be a corrugated cardboard, is withdrawn from the wrapping apparatus 20, rotated about 90° around a vertical axis, i.e. a rotation axis extending substantially normal to an upper surface of the first board 82, and a second board 84, for instance, a second piece of corrugated cardboard, is positioned under the wrapped load supported by the first board 82. If the second board 82 is a piece of corrugated cardboard, the second piece of corrugated cardboard is oriented with its flutes aligned substantially normal to the flutes of the first corrugated cardboard, if any. The assembly including the wrapped item(s) supported by the superposed boards, e.g. supported by the first corrugated cardboard 82 and the second piece of corrugated cardboard 84 with the flutes oriented substantially perpendicular to one another, is introduced in a second wrapping apparatus (or in the first wrapping apparatus) for a second wrapping cycle. While in the first wrapping cycle the flutes of the first corrugated cardboard 82 were oriented in the transverse direction, during the second wrapping cycle the flutes of the second corrugated cardboard 84 are oriented in the transverse direction. A second wrapping cycle is performed on this assembly to produce a final wrapped load, wrapped with two webs of packaging material W oriented in orthogonal planes and supported by a supporting tray 50 made of two boards (for instance, two corrugated cardboards 82, 84 with their flutes oriented in orthogonal directions). For very heavy and dense items, it is appreciated that the number of superposed boards can be increased, stiffer corrugated cardboard types can be used or a piece of sandwich panel (i.e. a two paper-based sheets sandwiching a layer of foam, honeycomb, and the like. Sandwich panels are characterized by a higher bending stiffness than corrugated boards for comparable thicknesses.) can be used instead of one of the pieces of cardboard.

Returning to FIG. 15, there is shown an item which has been wrapped as described above, i.e. wrapped first with a first packaging material web W1 on a single piece of first corrugated cardboard 82, as a part of the supporting tray 50, then wrapped additionally with a second packaging material web W2 on an additional piece of corrugated cardboard 84, with the flutes of the two boards 82, 84 being oriented in orthogonal directions. The first and the second wrappings are helicoidally wrappings using a relatively narrow strip of packaging material W, i.e. narrower than the item I being wrapped. After leaving the sequentially-mounted wrapping apparatuses, the lower one 84 of the corrugated cardboards can be folded, along folding lines 82 in order to be slid into container (box) for shipping purposes.

In the non-limitative embodiment shown in FIG. 15, the windings of the first packaging material web W1 are perpendicular to the windings of the second packaging material web W2. However, it is appreciated that the angle between the windings of the first and second packaging material web W1, W2 can vary from the 90 degrees angle shown in FIG. 15. For instance, the windings of the first and second packaging material web W1, W2 can define an oblique angle, i.e. an angle greater than zero but smaller than 90 degrees. In other words, the second web of packaging material W2 can define one of a perpendicular angle and an oblique angle with the first web of packaging material W1. Furthermore, it is appreciated that the load L can be wrapped with more than two webs of packaging material with angles defined between their windings.

Furthermore, the first windings and the second windings can be applied without adding a board to the supporting tray 50 inbetween. Thus, the first winding can be applied to a supporting tray including one or more superposed boards, and the second winding can be applied subsequently on the same supporting tray, i.e. including the same number of superposed boards.

In an embodiment the sequential wrapping of webs of packaging material can be performed by the same wrapping apparatus 20 and the method can include rotating the load between wrapping with the first web of packaging material W1 and wrapping with the second web of packaging material W2.

In another embodiment the sequential wrapping of webs of packaging material can be performed by different wrapping apparatuses, sequentially mounted in the wrapping line. Thus, the method can include: withdrawing the load from the first wrapping apparatus one (once?) the load has been wrapped with the first web of packaging material W1, inserting the load into a second wrapping apparatus, and then wrapping the load with the second web of packaging material W with the second wrapping apparatus. The method can also include wrapping the load in a first orientation with the first wrapping apparatus and wrapping the load in a second orientation with the second wrapping apparatus, wherein the second orientation is different from the first orientation. Between the two or more wrapping steps, the load can be rotated to modify its orientation.

Thus, the wrapped 3D load having an outer surface comprises a first web of packaging material forming at least one first loop surrounding the 3D load; and a second web of packaging material forming at least one second loop surrounding the 3D load and oriented perpendicular to the first loop or defining an oblique angle with the first loop.

Figure 16:
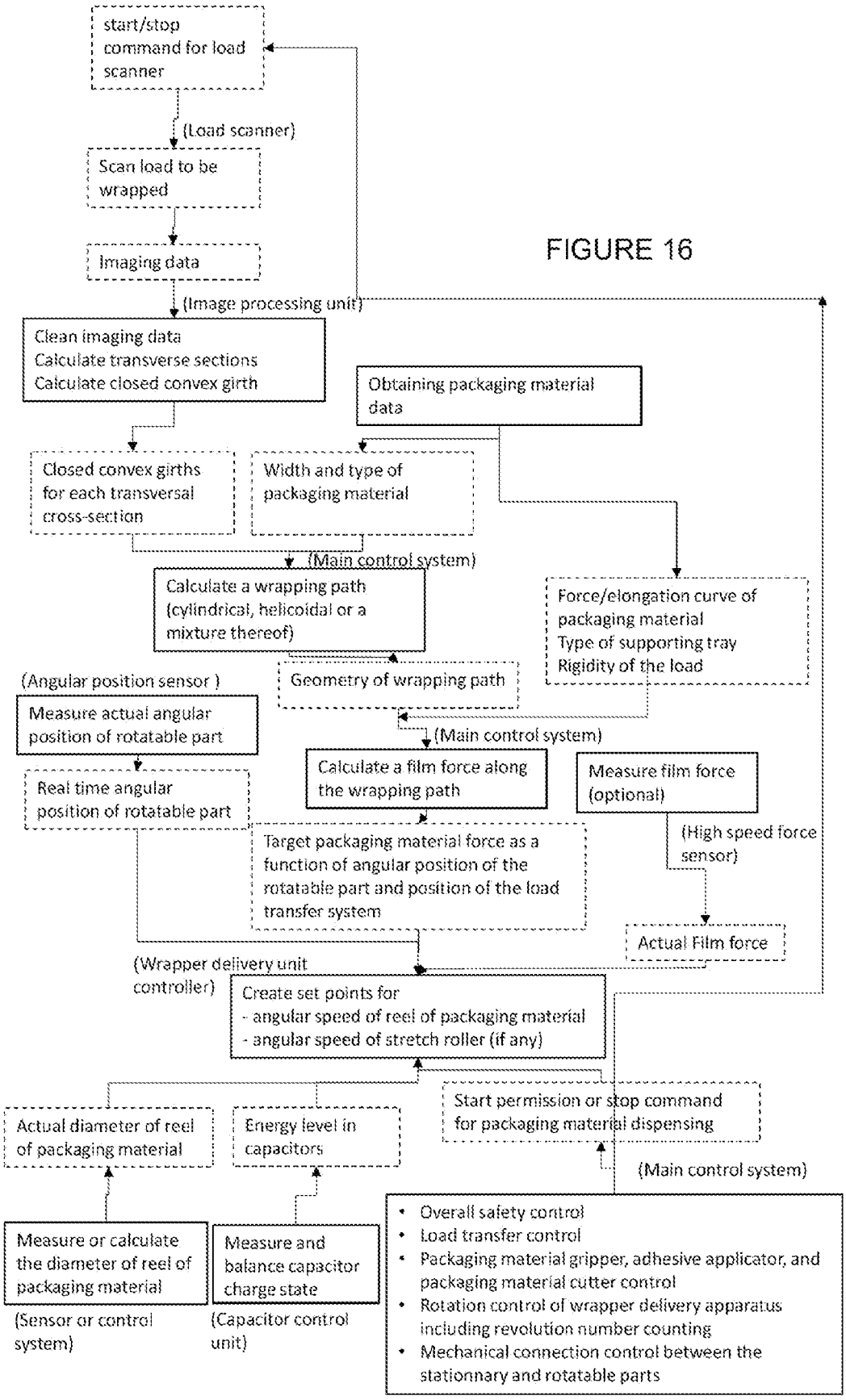
FIG. 16 is a flowchart of a method for wrapping a load in accordance with an embodiment.

Turning now to FIG. 16, there is shown an embodiment of a method for wrapping a load using a wrapping apparatus as described above. When a load L to be wrapped is supplied on the load transfer system 26, upstream the wrapping zone 27, imaging data of the load are obtained, for instance via the load scanner 40. As mentioned above, the load L can be stationary or being displaced while being scanned. The imaging data can be a 3D point cloud that is transferred to the image processing unit 42. The imaging data can then be image processed or cleaned by the image processing unit 42, for instance to detect and correct or remove inaccurate points (for instance, by filtering or other suitable data processing technique). Using the clean imaging data or the raw imaging data, the image processing unit 42 determines/calculates a plurality of transverse cross-sections 60 extending perpendicular to a surface (such as the upper surface 54) of the supporting tray 50, if any, (or the supporting (lower surface) of the item if the load L is free of supporting tray 50) and parallel to each other, i.e. from a lower surface of the load L. For each one of the transverse cross-sections 60, a convex curve 62 is derived using apex(es) of the item(s) and transversal ends of the supporting tray 50, if any, or transversal lower ends of the item(s) if the load L is free of supporting tray 50. For each one of the transverse cross-sections 60, the convex curve 62 is combined with a line 63 corresponding to a bottom surface 56 of the supporting tray 50 or the bottom surface of the item I to form a closed convex girth 64 surrounding and more particularly circumscribing the load L.

The closed convex girth data is transferred to a main control system of the wrapping apparatus. From the closed convex girth data and additional parameters including, but without being limited to, the configuration of wrapping path (cylindrical, helical or a combination thereof), the displacement of the load L during the wrapping process, the properties of the packaging material (its width, its type, its force/elongation curve, etc.), the properties of load (type of supporting tray, stiffness of the load L to be wrapped, etc.), a geometry of the wrapping path for the packaging material W, and the like.

Using the geometry of the wrapping path and optionally other process parameters including, but without being limited to, the force/elongation curve of the packaging material, the type of supporting tray, stiffness of the load L to be wrapped, etc., the main control system calculates a targeted packaging material force as a function of the angular position of the wrapper delivery apparatus 23, such as the rotatable ring 24, and a position of the load transfer system 26, i.e. the position of the load L in the wrapping zone 27.

Then, the load L can be introduced into the wrapping zone 27 and a free end of the wrapping material W can be attached to, for instance bonded to, the load L as detailed above. Then, a wrapping cycle can begin by engaging a relative rotation between the wrapper delivery apparatus 23 and the load L. During the wrapping cycle, the angular position of the wrapper delivery apparatus 23 can be monitored in real time. Optionally, the packaging material force and the diameter of the reel of packaging material 30 can also be monitored in real time.

In a non-limitative embodiment the angular speed of the stretch roller servomotor, if any, can be adjusted based on a predetermined stretch ratio. The angular speed of the reel servomotor can be derived from a real-time length of packaging material that has to be delivered to the load being wrapped, i.e. the wrapper (packaging material) demand.

Set points for the angular speed of the reel of packaging material 30 and the angular speed of the stretch roller 33 can be predetermined as a function of the angular position of the wrapper delivery apparatus 23. They can also be adjusted/implemented in real time using the available information including the real time diameter of the reel of packaging material 30, the real time angular position of the wrapper delivery apparatus 23, the real time packaging material force, and the targeted packaging material force as a function of the angular position of the wrapper delivery apparatus 23. The set points for the angular speed of the reel of packaging material 30 and the angular speed of the stretch roller 33 can be calculated/determined by a wrapper delivery unit control system 38, which in turn is operatively connected to the actuators of the stretch roller(s) 33, if any, and the wrapper reel receiving shaft 32.

Once the wrapping path is completed, the packaging material can be cut and the free end can be attached to the load (either on a previous winding of the packaging material, the item itself, or the supporting tray). The wrapped load is withdrawn from the wrapping apparatus, which is ready to wrap a new load.

It will be appreciated that the methods described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A wrapping apparatus for wrapping a load being one or more items placed on a supporting tray, the apparatus comprising:

a wrapper delivery apparatus rotatable around the load to be wrapped;

an angular position sensor at least partially mounted to the wrapper delivery apparatus;

a wrapper delivery unit mounted to the wrapper delivery apparatus, said wrapper delivery unit comprising a servomotor and a wrapper reel receiving unit arranged for mounting packaging material, said servomotor operatively connected to said wrapper reel receiving unit to drive a reel of said wrapper reel receiving unit in rotation, a wrapper delivery unit controller in data communication with the angular position sensor and operatively connected to the servomotor, the wrapper delivery unit controller being configured to process data supplied by the angular position sensor to determine an angular position of the wrapper delivery apparatus around the load using said data and to control the servomotor based on the determined angular position of the wrapper delivery apparatus around the load.

2. The wrapping apparatus as in claim 1, wherein the wrapper delivery unit comprises a stretch roller and a stretch roller servomotor operatively connected to the stretch roller to engage the stretch roller in rotation.

3. A method for wrapping a load, said load being one or more items placed on a supporting tray, the method comprising:

engaging in rotation a wrapper delivery apparatus around the load, the wrapper delivery apparatus comprising an angular position sensor and a wrapper delivery unit with a servomotor, said servomotor operatively connected to a wrapper reel receiving unit to drive a reel of said wrapper reel receiving unit in rotation;

sending data collected by the angular position sensor to a wrapper delivery unit controller;

deriving an angular position of the wrapper delivery apparatus using data supplied by the angular position sensor; and adjusting a speed of the servomotor driving the reel of the wrapper reel receiving unit as a function of the angular position of the wrapper delivery apparatus.

4. The method for wrapping a load as in claim 3, further comprising obtaining an image from a load to be wrapped; deriving a wrapping path of a packaging material; and using the derived wrapping path for wrapping the packaging material around the load.

5. The method for wrapping as in claim 4, wherein obtaining an image from the load comprises scanning the load and obtaining a 3D point cloud.

6. The method for wrapping as in claim 5, further comprising image processing the obtained 3D point cloud and calculating a plurality of cross-sections extending perpendicular to a surface of the supporting tray.

7. The method for wrapping as in claim 4, wherein from said image obtained from said load a wrapper stretch ratio is obtained, the method further comprising obtaining a wrapper demand; and adjusting a speed of at least one servomotor as a function of the wrapper stretch ratio and the wrapper demand.

8. The method for wrapping as in claim 4, wherein said packaging material is stretchable cellulose-based paper stretchable from about 10% to about 30% of its length, having a thickness ranging between about 50 grams/square meter ($g/m^2$) to about 400 $g/m^2$, and wherein said packaging material is taken from a reel of packaging material, said reel being connected to a single reel servomotor.

9. The method for wrapping as in claim 3, wherein the supporting tray comprises an item supporting portion and outer portions.

10. The method for wrapping as in claim 9, wherein at least a part of opposing sides of the item supporting portion is trapezium-shaped.

11. The method for wrapping as in claim 10, wherein on said trapezium-shaped part of said opposing sides cut-out portions are provided.

12. The method for wrapping as in claim 11, wherein said cut-out portions have a stepwise inwardly decreasing length, said length being measured in a direction parallel to the opposing sides.

13. The method for wrapping as in claim 9, wherein said supporting tray is a stack of superposed boards.

14. The method for wrapping as in claim 13, wherein the supporting tray comprises a plurality of superposed boards comprising corrugated cardboards wherein flutes of a first one of the corrugated cardboards are oriented in an orthogonal direction to flutes of a second one of the corrugated cardboards.

* * * * *